US008121315B2

(12) United States Patent
Song et al.

(10) Patent No.: US 8,121,315 B2
(45) Date of Patent: Feb. 21, 2012

(54) CONDENSER MICROPHONE CHIP

(75) Inventors: Qinglin Song, Beijing (CN); Yongchun Tao, Beijing (CN); Shengli Pang, Beijing (CN); Tongqing Liu, Beijing (CN)

(73) Assignee: Goer Tek Inc., Weifang, Shangdong Province (CH)

( * ) Notice: Subject to any disclaimer, the term of this patent is extended or adjusted under 35 U.S.C. 154(b) by 1148 days.

(21) Appl. No.: 11/929,242

(22) Filed: Oct. 30, 2007

(65) Prior Publication Data

US 2008/0232615 A1 Sep. 25, 2008

(30) Foreign Application Priority Data

Mar. 21, 2007 (CN) ..... 2007 1 0064610
Jun. 6, 2007 (CN) ..... 2007 1 0100243

(51) Int. Cl.
*H04R 25/00* (2006.01)

(52) U.S. Cl. ..... 381/174; 381/113; 381/116

(58) Field of Classification Search ..... 381/113, 381/116, 174, 175; 361/170, 180
See application file for complete search history.

(56) References Cited

U.S. PATENT DOCUMENTS 5,146,435 A 9/1992 Bernstein
5,452,268 A 9/1995 Bernstein
5,870,482 A 2/1999 Loeppert et al.
6,012,335 A 1/2000 Bashir et al.

(Continued)

FOREIGN PATENT DOCUMENTS

CN 1787693 A 6/2006

OTHER PUBLICATIONS

Bourouina et al., "A new condenser microphone with a p+ silicon membrane", *Sensors and Actuators A*. (1992) 31:149-152.

(Continued)

*Primary Examiner* — Phuc Dang
(74) *Attorney, Agent, or Firm* — Knobbe Martens Olson & Bear LLP

(57) ABSTRACT

Disclosed is a condenser microphone chip, comprising: a substrate (21); a diaphragm (26) spaced from the substrate; a curved beam (27) connected with the diaphragm (26) to anchor the diaphragm (26) to the substrate (21); a curved beam connecting part (29) having a shape of a substantially circular plate. The curved beam (27) is arranged in the diaphragm (26). The curved beam (27) includes a plurality of sub beams, each of the plurality of sub beams including a first sub beam portion extending in a substantially radial direction from a circumference of the curved beam connecting part (29); a second sub beam portion extending in a substantially circumferential direction from an end of the first sub beam portion away from the circumference of the curved beam connecting part (29) and having a shape of a substantial arc; and a third sub beam portion extending in the radial direction from an end of the second sub beam portion away from the first sub beam portion and connected to the diaphragm (26). The condenser microphone chip according to the present invention is high in sensitivity, low in noise, wide in frequency band, simple in manufacturing process, and high in reliability. In addition, the condenser microphone chip can be easily manufactured in mass production.

28 Claims, 14 Drawing Sheets

U.S. PATENT DOCUMENTS

| | | | | |
|---|---|---|---|---|
| 6,140,689 | A | 10/2000 | Scheiter et al. | |
| 6,532,460 | B1 | 3/2003 | Amanat et al. | |
| 6,535,460 | B2 | 3/2003 | Loeppert et al. | |
| 6,622,368 | B1 | 9/2003 | Mullenborn et al. | |
| 6,667,189 | B1 | 12/2003 | Wang et al. | |
| 6,677,176 | B2 | 1/2004 | Wong et al. | |
| 7,573,547 | B2 * | 8/2009 | Palmateer et al. | 349/106 |
| 7,912,235 | B2 * | 3/2011 | Chen | 381/174 |
| 2006/0093170 | A1 | 5/2006 | Zhe et al. | |
| 2007/0201710 | A1 * | 8/2007 | Suzuki et al. | 381/174 |
| 2009/0208037 | A1 * | 8/2009 | Zhe | 381/174 |

OTHER PUBLICATIONS

Hsu et al., "A high sensitivity polysilicon diaphragm condenser microphone", *MEMS Conference*, Heidelberg, Germany Jan. 25-29, 1998, p. 580-585.

Puers et al. "A subminiature capacitive movement detector using a composite membrane suspension", *Sensors and Actuators A*. (1992) 31:90-96.

Scheeper et al. "Frabrication of silicon condenser microphones using single wafer technology", *J Microelectromechanical Sys*. (1992) 1(3):147-154.

* cited by examiner

CONDENSER MICROPHONE CHIP

BACKGROUND OF THE INVENTION

1. Field of the Invention

The present invention relates to a semiconductor condenser microphone chip.

2. Description of the Related Art

A condenser microphone chip is a capacitor composed of a diaphragm and a backplate. Currently, in most reports and patents a double-membrane capacitor structure which is manufactured by forming a diaphragm and a backplate on a silicon wafer by micromachining is adopted. Few efforts are made to the development of single-membrane silicon condenser microphone. A single-membrane silicon condenser microphone is reported in "Fabrication of Silicon Condenser Microphone Using Single Wafer Technology", Journal of microelectromechanical systems, VOL. 1. No. 3, 1992, p 147-154. In the single-membrane silicon condenser microphone, a capacitor structure is formed by an edge portion of a diaphragm and a silicon substrate with the silicon substrate serving as a backplate and with a large hole at a center of the backplate serving as a sound hole. However, the single-membrane silicon condenser microphone is disadvantageous because an edge of the diaphragm is connected to a peripheral portion. When a sound wave is applied to the diaphragm, a maximum vibration occurs at a center portion of the diaphragm, and a small vibration is generated at the edge portion of the diaphragm. Because the center portion of the diaphragm is directly opposite to the sound hole of the backplate, mechanical sensitivity in the region with maximum amplitude is not used, so that the mechanical sensitivity of the diaphragm contributes less to sensitivity of the microphone.

In order that a diaphragm has good vibration performance, a residual stress in the diaphragm can be reduced. In the Publication titled Sensor and Actuators A. 31, 1992, 90-96, a material with tensile stress and a material with compressive stress are used to make a low-stress composite membranes for a microphone. In U.S. Pat. No. 6,622,368B1 in which silicon nitride/polysilicon/silicon nitride composite membrane structure is disclosed, the low-stress composite membrane is used as a diaphragm of a microphone. In the Publication "Sensor and Actuators A. 31, 1992, 149-152" and U.S. Pat. No. 6,012,335, a monocrystalline silicon diaphragm is made by doping monocrystalline silicon with boron. In the Publication "A High Sensitivity Polysilicon Diaphragm Condenser Microphone", 1998 MEMS Conference, Heideberg Germany January 25-29, it is reported that a diaphragm is made with low-stress polysilicon. However, requirements for a growing process of a membrane is strict and it is difficult to assure uniformity of the membrane if vibration performance of the diaphragm is improved only by making a material of low residual stress.

In addition, the methods for releasing residual stress in a diaphragm with various structures have been known in the art. In the Publication U.S. Pat. Nos. 5,452,268 and 5,146,435, Chinese Patent Publication No. 1787693A, and a literature (The 11th International Conference on Solid-State Sensors and Actuators, Munich Germany, Jun. 10-14, 2001), mechanical sensitivity of a diaphragm is improved by releasing residual stress in the diaphragm by using a cantilever structure. Since stress in the diaphragm is concentrated at an edge of the diaphragm due to the cantilever structure and the beam structure is often too soft, an adhesion problem is apt to occur. In U.S. Pat. No. 6,535,460 B2, a free diaphragm structure is disclosed. With the free diaphragm structure, a microphone with a diaphragm of residual stress of zero can be obtained, but a process required for preparing the structure is complicated.

A rigid backplate is a premise for a microphone having good frequency characteristic and low noise. Currently, methods for making a rigid backplate comprises: employing a thick gold layer as a backplate in U.S. Pat. No. 6,012,335; employing a composite metal membrane as a backplate, which increases thickness of the backplate while decreasing stress in the backplate, in U.S. Pat. No. 6,677,176 B2; employing a monocrystalline silicon layer in a SOI silicon wafer as a backplate in U.S. Pat. No. 6,140,689; employing electrochemical corrosion to make a low-stress thick monocrystalline silicon backplate in U.S. Pat. No. 6,667,189 B1; and making a particular structure to increase strength of a backplate in U.S. Pat. No. 6,532,460 B2. However, most of the above processes are complicated and are high in manufacturing cost.

After a soft diaphragm and a rigid backplate are obtained, it is also necessary to solve the problem that the diaphragm is attached or adhered to the backplate. Up to now, there have been many methods. An effective method is to make attachment or adhesion preventing protrusions, but it is necessary to increase a number of processing steps and thus cost.

In U.S. Pat. No. 5,870,482, a cantilever beam type diaphragm is described. A cantilever beam is fixed at an end, and constitutes a capacitor at an edge portion of a free end with a backplate. With the above configuration, mechanical sensitivity makes great contribution to microphone sensitivity, but structure of the diaphragm is complicated. In addition, because of the cantilever structure having 3 DOF (Dimension of Freedom), it is difficult to assure pose and reliability of the diaphragm. In U.S. Pat. Application Publication No. 2006/0093170 A1, a single membrane structure in which outer cantilever beams are distributed at equal intervals is disclosed. An edge portion of a diaphragm and the backplate form a capacitor. The cantilever beams improve contribution of mechanical sensitivity to microphone sensitivity, but can not enable the diaphragm to translate. In addition, with the above configuration, it is difficult to assure yield and reliability.

SUMMARY OF THE INVENTION

It is an object of the present invention to provide a condenser microphone chip having a curved beam which can alleviate at least a part of the above problems.

It is another object of the present invention to provide a condenser microphone chip having a curved beam which can effectively release residual stress in a diaphragm, prevent attachment or adhesion of the diaphragm to a backplate, and improve the reliability of condenser microphone chip.

According to an aspect of the invention, there is provided a condenser microphone chip comprising: a substrate; a diaphragm spaced from the substrate; and a curved beam connected with the diaphragm to anchor the diaphragm to the substrate.

With the above configuration, residual stress in the diaphragm of the condenser microphone chip can be released by the curved beam. The soft curved beam serves as a spring so as to assure easy vibration of the diaphragm.

The curved beam may extend in one of a substantial "S" shape, a shape of a substantial arc, and a substantial helical shape.

According to an aspect of the invention, the curved beam includes one curved beam disposed at a substantial center portion of the diaphragm. Alternatively, the curved beam may include at least one pair of curved beams arranged at substantially equal intervals and substantially symmetrical about a center of the diaphragm.

According to an aspect of the invention, the curved beam is arranged in the diaphragm.

In the case that the curved beam is arranged in the diaphragm, the diaphragm can be prevented from being attached to the backplate during manufacturing. Moreover, the entire diaphragm can uniformly vibrate and mechanical sensitivity of the diaphragm can be fully utilized.

Preferably, the condenser microphone chip further comprises a curved beam connecting part having a shape of a substantially circular plate, wherein the curved beam is arranged in the diaphragm, and wherein each curved beam includes a plurality of sub beams, each of the plurality of sub beams including a first sub beam portion extending in a substantially radial direction of the curved beam connecting part from a circumference of the curved beam connecting part; a second sub beam portion extending in a substantially circumferential direction of the curved beam connecting part or around the curved beam connecting part from an end of the first sub beam portion away from the circumference of the curved beam connecting part and having a shape of a substantial arc; and a third sub beam portion extending in the radial direction from an end of the second sub beam portion away from the first sub beam portion and connected to the diaphragm.

According to an aspect of the invention, the curved beam may comprise three sub beams.

The second sub beam portions of the plurality of the sub beams of the curved beam may extend toward an identical circumferential direction from the ends of the first sub beam portions away from the circumference of the curved beam connecting part.

The plurality of the sub beams of the curved beam may have a substantially identical shape. In addition, the plurality of the sub beams of the curved beam may be arranged at substantially equal intervals around the circumference of the curved beam connecting part.

According to an aspect of the invention, the condenser microphone chip further comprises: an auxiliary beam including a first portion configured by forming an opening in the diaphragm at a predetermined distance from an edge of the diaphragm, the first portion having two ends connected with the diaphragm; and a second portion extending from the first portion away from the diaphragm, the second portion being fixed to the substrate at an end of the second portion away from the first portion.

According to another aspect of the invention, the condenser microphone chip further comprises: an auxiliary beam including a first elongated portion configured by forming an opening in the diaphragm substantially parallel to an edge of the diaphragm at a predetermined distance from the edge, the first portion having two ends connected with the diaphragm; and a second elongated portion extending away from the diaphragm from a substantially middle portion of the first portion, the second portion being fixed to the substrate at an end of the second portion away from the first portion, and the first portion and the second portion being formed in a "T" shape together.

According to an aspect of the invention, the condenser microphone chip further comprises: a curved beam support which is fixed to the substrate and to which an end of the curved beam of the curved beam is connected; and a diaphragm side electrode which is attached to the end of the curved beam connected to the curved beam support so as to be electrically connected with the diaphragm.

According to another aspect of the invention, the condenser microphone chip further comprises: an auxiliary beam support fixed to the substrate, the end of the second portion of the auxiliary beam being fixed to the substrate by connecting to the auxiliary beam support; and a diaphragm side electrode which is attached to the end of the second portion of the auxiliary beam connected to the auxiliary beam support so as to be electrically connected with the diaphragm.

The above curved beam is applicable to a double-membrane condenser microphone chip, a single-membrane condenser microphone chip, and other condenser microphone chips.

In a condenser microphone chip according to the present invention, the substrate serves as the backplate, the substrate may have a large hole, that is, a sound hole, at a center portion thereof, and the diaphragm covers the sound hole. A plurality of small holes are disposed in the diaphragm outside a region of the diaphragm directly opposite to the sound hole. The plurality of small holes cooperate with the sound hole of the backplate to release a sacrificial layer between the diaphragm and the backplate during manufacturing and can improve frequency response characteristic of the condenser microphone chip.

In a condenser microphone chip according to the present invention, a diaphragm is fixedly attached to a substrate with a curved beam arranged within the diaphragm. With this configuration, residual stress in the diaphragm can effectively be released, and the diaphragm can be prevented from being attached to a backplate and be improved in reliability. In addition, the backplate has a large stiffness since the substrate servers as the backplate. Therefore, the condenser microphone chip according to the present invention is simple in structure, low in process difficulty and cost, and high in reliability.

In a condenser microphone chip according to the present invention, a curved beam is arranged within the diaphragm. The curved beam can well release residual stress of the diaphragm. In addition, the curved beam serves as a spring to connect and support the diaphragm, so that the diaphragm can vibrate well. Furthermore, the curved beam can uniformly support the diaphragm when the curved beam is arranged in the diaphragm. As a result, this arrangement can effectively prevent attachment of the diaphragm to the backplate due to electrostatic force, van de waals force and capillary force during the manufacturing process, thereby improving reliability of the condenser microphone chip.

According to further aspect of the present invention, there is provided a condenser microphone chip comprising: a substrate; a backplate connected with the substrate; a diaphragm spaced from the backplate, for example, by a predetermined distance; and a curved beam connected with the diaphragm to anchor the diaphragm to the substrate.

The curved beam may extend in one of a substantial "S" shape, a shape of a substantial arc, and a substantial helical shape.

According to an aspect of the present invention, the curved beam includes one curved beam disposed at a substantial center portion of the diaphragm.

According to an aspect of the present invention, the curved beam includes at least one pair of curved beams arranged at substantially equal intervals and substantially symmetrical about a center of the diaphragm.

According to another aspect of the present invention, the curved beam is arranged in the diaphragm.

According to an aspect of the invention, the condenser microphone chip further comprises: a curved beam connecting part having a shape of a substantially circular plate, wherein the curved beam is arranged in the diaphragm, and wherein each curved beam includes a plurality of sub beams, each of the plurality of sub beams including a first sub beam portion extending in a substantially radial direction from a circumference of the curved beam connecting part; a second sub beam portion extending in a substantially circumferential direction from an end of the first sub beam portion away from the circumference of the curved beam connecting part and having a shape of a substantial arc; and a third sub beam portion extending in the radial direction from an end of the second sub beam portion away from the first sub beam portion and connected to the diaphragm.

According to an aspect of the present invention, each curved beam comprises three sub beams.

According to another aspect of the present invention, the second sub beam portions of the plurality of the sub beams of the curved beam extend toward an identical circumferential direction from the ends of the first sub beam portions away from the circumference of the curved beam connecting part.

The plurality of the sub beams of the curved beam may have a substantially identical shape. In addition, the plurality of the sub beams of the curved beam are arranged at substantially equal intervals around the circumference of the curved beam connecting part.

According to an aspect of the present invention, the condenser microphone chip further comprises: an auxiliary beam including a first portion configured by forming an opening in the diaphragm at a predetermined distance from an edge of the diaphragm, the first portion having two ends connected with the diaphragm; and a second portion extending from the first portion away from the diaphragm, an end of the second portion away from the first portion being fixed to the substrate.

With the above configuration, when sound wave acts on the diaphragm, the diaphragm transmits a force applied to the diaphragm to the curved beam and the auxiliary beam so that the curved beam and the auxiliary beam deform. Since deformation mainly occurs at the curved beam and the auxiliary beam, the diaphragm vibrates back and forth in a direction perpendicular to a surface of the diaphragm, and the vibration is of translation all over the diaphragm. As a result, an amount of displacement of the diaphragm is converted into a change in capacitance to achieve a function of a sensor.

According to an aspect of the present invention, the condenser microphone chip further comprises: an auxiliary beam including a first elongated portion configured by forming an opening in the diaphragm substantially parallel to an edge of the diaphragm at a predetermined distance from the edge, the first portion having two ends connected with the diaphragm; and a second elongated portion extending away from the diaphragm from a substantially middle portion of the first portion, an end of the second portion away from the first portion being fixed to the substrate, and the first portion and the second portion being formed in a "T" shape together.

With the above configuration, the curved beam and the auxiliary beam may be uniformly arranged within and outside the diaphragm, respectively. Therefore, stress is uniformly distributed in the diaphragm, and vibration amplitude is substantially uniform all over the diaphragm. Attachment of the diaphragm to the backplate can be effectively prevented while sensitivity is ensured.

According to an aspect of the present invention, the condenser microphone chip further comprises: a curved beam support which is fixed to the substrate and to which the curved beam is connected at an end of the curved beam; and a diaphragm side electrode which is attached to the end of the curved beam connected to the curved beam support so as to be electrically connected with the diaphragm.

According to an aspect of the present invention, the condenser microphone chip further comprises: an auxiliary beam support fixed to the substrate, the end of the second portion of the auxiliary beam being fixed to the substrate by connecting to the auxiliary beam support; and a diaphragm side electrode which is attached to the end of the second portion of the auxiliary beam connected to the auxiliary beam support so as to be electrically connected with the diaphragm.

According to an aspect of the present invention, the substrate has a through hole, and the backplate has a suspended region opposite to the through hole of the substrate.

With the above configuration, a center portion of the backplate may be suspended and a portion of the backplate layer surrounding the center portion may be supported by the substrate, to increase stiffness of the backplate.

The suspended region may have a plurality of sound holes. In addition, the condenser microphone chip may further comprise a dielectric layer disposed between the substrate and the backplate. The dielectric layer may have an slit generally aligned with and identical with an opening of the through hole opened at a side of the dielectric layer.

According to an aspect of the present invention, the condenser microphone chip further comprises an opening located at a center of the suspended region.

According to an aspect of the present invention, the condenser microphone chip further comprises a reinforcing rib connected with the backplate for reinforcing the stiffness of the backplate.

According to another aspect of the present invention, the condenser microphone chip further comprises a reinforcing rib connected with the backplate and extending from a position outside the suspended region to the suspended region or toward a center of the suspended region for reinforcing the stiffness of the backplate.

With the above configuration, the stiffness of the backplate is further increased by providing the reinforcing rib at the suspended region. Since only a portion of the backplate is suspended and the reinforcing rib is disposed at the suspended region, it is easier to obtain a rigid backplate. Therefore, difficulty in process and cost are reduced and rate of finished products is increased.

Preferably, the diaphragm has an opening located corresponding to the reinforcing rib; and the reinforcing rib protrudes from the backplate into the opening of the diaphragm with a slit formed between the reinforcing rib and an edge of the opening.

According to an aspect of the present invention, the reinforcing rib comprises four reinforcing ribs arranged at substantially equal intervals and substantially symmetrical about a center of the suspended region.

According to an aspect of the present invention, the reinforcing rib comprises a dielectric strip located in the same layer as the curved beam support, and a conductive strip fixed to the dielectric strip and located in the same layer as the diaphragm.

According to another aspect of the present invention, the condenser microphone chip further comprises a supporting member supported between the diaphragm and the suspended region, wherein a predetermined region of the suspended region around the supporting member has a stiffness lower than that of the other region of the suspended region.

The supporting member may be positioned at a center portion of the suspended region.

Preferably, the predetermined region of the suspended region comprises: an opening formed at a center portion of the suspended region, a backplate beam connecting part located at a center portion of the opening, and a plurality of backplate beams connected between the backplate beam connecting part and an edge of the opening.

With the above configuration, when sound wave acts on the diaphragm, the diaphragm transmits a force applied to the diaphragm to the backplate beam and the curved beam so that the backplate beam and the curved beam deform. Since deformation mainly occurs at the backplate beam and the curved beam, the diaphragm vibrates in a direction perpendicular to a surface of the diaphragm, and motion of translation is generated all over the diaphragm. As a result, an amount of displacement of the vibration of the diaphragm is converted into a change in capacitance to achieve a function of a sensor.

The plurality of backplate beams may comprise four backplate beams arranged at substantially equal intervals and substantially symmetrical about a center of the suspended region.

According to an aspect of the present invention, the supporting member is supported between the diaphragm and the backplate beam connecting part of the suspended region.

With the above configuration, when the diaphragm vibrates, stress is uniformly distributed in the diaphragm of the condenser microphone chip and probability of attachment of the diaphragm to the backplate is effectively reduced so that rate of finished products is increased. In addition, the diaphragm has good vibration characteristics due to the curved beam, the auxiliary beam and the backplate beam.

According to an aspect of the present invention, the condenser microphone chip further comprises a reinforcing rib connected with the backplate for reinforcing a stiffness of a region of the backplate except the predetermined region of the suspended region.

According to another aspect of the present invention, the condenser microphone chip further comprises a reinforcing rib connected with the backplate and extending from a position outside the suspended region to the suspended region or toward a center of the suspended region for reinforcing a stiffness of a region of the backplate except the predetermined region of the suspended region.

In the above condenser microphone chip having the predetermined region of the suspended region, the diaphragm has an opening located corresponding to the reinforcing rib; and the reinforcing rib protrudes from the backplate into the opening of the diaphragm with a slit formed between the reinforcing rib and an edge of the opening.

According to an aspect of the invention, a plurality of small holes are disposed in an edge portion of the diaphragm. The plurality of small holes cooperate with the sound holes of the suspended region of the backplate to release a sacrificial layer between the diaphragm and the backplate during manufacturing process and can improve frequency response characteristics of the condenser microphone chip.

According to a further aspect of the present invention, there is provided a condenser microphone chip comprising: a substrate having a through hole; a backplate connected with the substrate and having a suspended region opposite to the through hole of the substrate; a diaphragm spaced from the backplate, for example, by a predetermined distance; and a supporting member supported between the diaphragm and the suspended region, wherein a predetermined region of the suspended region around the supporting member has a stiffness lower than that of the other region of the suspended region.

According to an aspect of the present invention, the condenser microphone chip further comprises a curved beam connected with the diaphragm to anchor the diaphragm to the substrate.

The curved beam may extend in one of a substantial "S" shape, a shape of a substantial arc, and a substantial helical shape.

According to another aspect of the present invention, the curved beam includes at least one pair of curved beams arranged at substantially equal intervals and substantially symmetrical about a center of the diaphragm.

The curved beam may be arranged in the diaphragm.

According to an aspect of the invention, the condenser microphone chip further comprises: an auxiliary beam including a first portion configured by forming an opening in the diaphragm at a predetermined distance from an edge of the diaphragm, the first portion having two ends connected with the diaphragm; and a second portion extending from the first portion away from the diaphragm, the second portion being fixed to the substrate at an end of the second portion away from the first portion.

According to another aspect of the present invention, the condenser microphone chip further comprises: an auxiliary beam including a first elongated portion configured by forming an opening in the diaphragm substantially parallel to an edge of the diaphragm at a predetermined distance from the edge, the first portion having two ends connected with the diaphragm; and a second elongated portion extending away from the diaphragm from a substantially middle portion of the first portion, the second portion being fixed at an end of the second portion away from the first portion to the substrate, and the first portion and the second portion being formed in a "T" shape together.

According to an aspect of the present invention, the condenser microphone chip further comprises: a curved beam support which is fixed to the substrate and connected with an end of the curved beam; and a diaphragm side electrode which is attached to the end of the curved beam connected to the curved beam support so as to be electrically connected with the diaphragm.

According to another aspect of the present invention, the condenser microphone chip further comprises: an auxiliary beam support fixed to the substrate, the end of the second portion of the auxiliary beam being fixed to the substrate by connecting to the auxiliary beam support; and a diaphragm side electrode which is attached to the end of the second portion of the auxiliary beam connected to the auxiliary beam support so as to be electrically connected with the diaphragm.

According to an aspect of the present invention, the condenser microphone chip further comprises: a curved beam connecting part having a shape of a substantially circular plate, wherein the curved beam is arranged in the diaphragm, and wherein each curved beam includes a plurality of sub beams, each of the plurality of sub beams including a first sub beam portion extending in a substantially radial direction from a circumference of the curved beam connecting part; a second sub beam portion extending in a substantially circumferential direction from an end of the first sub beam portion away from the circumference of the curved beam connecting part and having a shape of a substantial arc; and a third sub beam portion extending in the radial direction from an end of the second sub beam portion away from the first sub beam portion and connected to the diaphragm.

According to an aspect of the present invention, each curved beam comprises three sub beams.

According to an aspect of the present invention, the second sub beam portions of the plurality of the sub beams of the curved beam extend toward an identical circumferential direction from the ends of the first sub beam portions away from the circumference of the curved beam connecting part.

The plurality of the sub beams of the curved beam may have a substantially identical shape. In addition, the plurality of the sub beams of the curved beam may be arranged at substantially equal intervals around the circumference of the curved beam connecting part.

The suspended region may have a plurality of sound holes. In addition, the condenser microphone chip may further comprise a dielectric layer disposed between the substrate and the backplate. The dielectric layer may have an opening generally aligned with and identical with an opening of the through hole opened at a side of the dielectric layer.

According to an aspect of the present invention, the condenser microphone chip may further comprise: a reinforcing rib connected with the backplate for reinforcing a stiffness of a region of the backplate except the predetermined region of the suspended region.

According to another aspect of the present invention, the condenser microphone chip further comprises: a reinforcing rib connected with the backplate and extending from a position outside the suspended region to the suspended region or toward a center of the suspended region for reinforcing a stiffness of a region of the backplate except the predetermined region of the suspended region.

According to an aspect of the present invention, the diaphragm has an opening located corresponding to the reinforcing rib; and the reinforcing rib protrudes from the backplate into the opening of the diaphragm with a slit formed between the reinforcing rib and an edge of the opening.

According to an aspect of the present invention, the reinforcing rib comprises four reinforcing ribs arranged at substantially equal intervals and substantially symmetrical about a center of the suspended region.

According to an aspect of the present invention, the reinforcing rib comprises a dielectric strip located in the same layer as the curved beam support, and a conductive strip fixed to the dielectric strip and located in the same layer as the diaphragm.

According to an aspect of the present invention, the supporting member is positioned at a center portion of the suspended region.

According to an aspect of the present invention, the predetermined region of the suspended region comprises: an opening formed at a center portion of the suspended region, a backplate beam connecting part located at a center portion of the opening, and a plurality of backplate beams connected between the backplate beam connecting part and an edge of the opening. The backplate beam connecting part may have one of a square shape, a circular shape, and a polygonal shape. In addition, the opening may have one of a square shape, a circular shape, and a polygonal shape.

According to an aspect of the present invention, the plurality of backplate beams comprise four backplate beams arranged at substantially equal intervals and substantially symmetrical about a center of the suspended region.

According to another aspect of the present invention, the supporting member is supported between the diaphragm and the backplate beam connecting part of the suspended region.

BRIEF DESCRIPTION OF THE DRAWINGS

These and/or other aspects and advantages of the present invention will become apparent and more readily appreciated from the following description of the embodiments, taken in conjunction with the accompanying drawing.

DETAILED DESCRIPTION OF THE EMBODIMENTS

Figure 1:
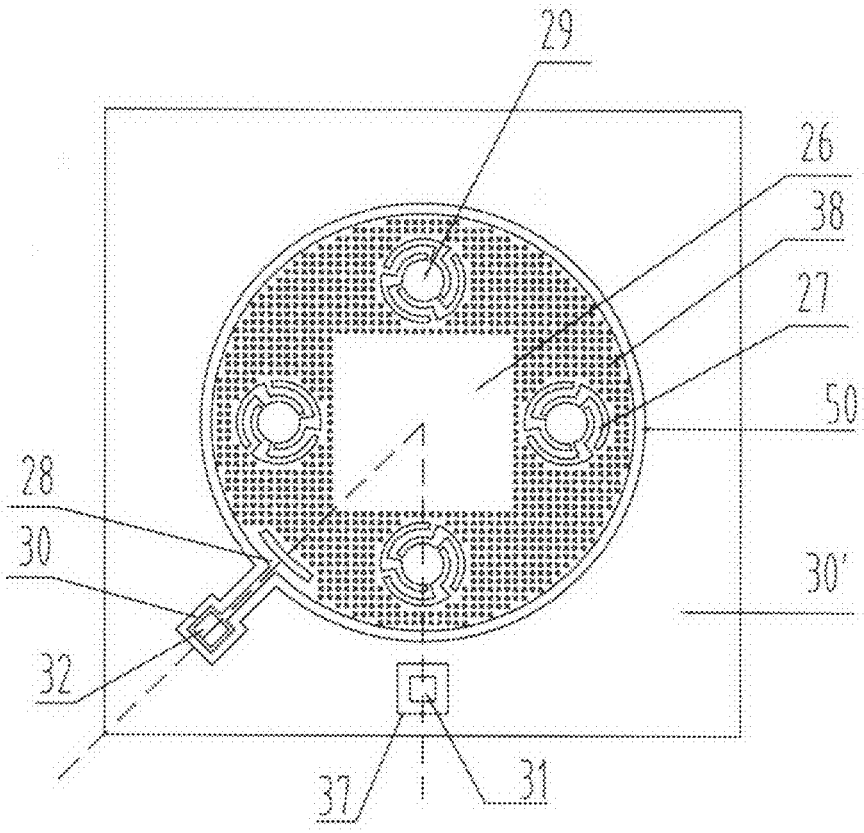
FIG. 1 is a schematic top view of a condenser microphone chip with a diaphragm supported by four curved beams and one auxiliary beam in accordance with a first embodiment of the present invention.
Figure 2:
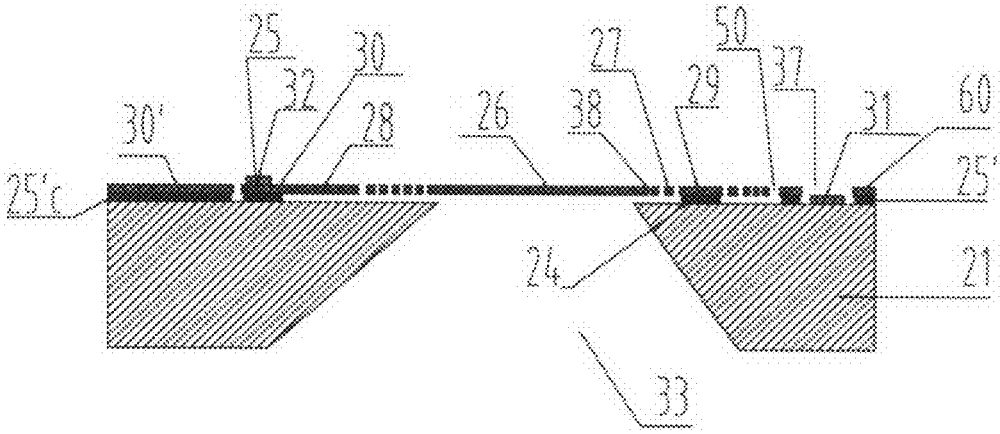
FIG. 2 is a schematic sectional view showing the condenser microphone chip with the diaphragm supported by the four curved beams and the one auxiliary beam in accordance with the first embodiment of the present invention and taken along broken lines shown in FIG. 1.

Reference will now be made in detail to the embodiments of the present invention, examples of which are illustrated in the accompanying drawings, wherein like reference numerals refer to the like elements throughout. The embodiments are described below in order to explain the present invention by referring to the figures.

First Embodiment

The first embodiment according to the present invention will be described hereinafter with reference to FIGS. 1 through 6.

Referring to FIGS. 1 to 6, a condenser microphone chip according to a first embodiment of the present invention comprises: a substrate 21; a diaphragm 26 spaced from the substrate 21, for example, by a predetermined distance; and a curved beam 27 connected with the diaphragm 26 to anchor the diaphragm 26 to the substrate 21. The curved beam 27 may extend in one of a substantial "S" shape, a shape of a substantial arc, and a substantial helical shape. The curved beam 27 is illustrated as a beam extending in the "S" shape in FIG. 1. The condenser microphone chip may further comprise a dielectric layer 251 connected fixedly with or on a surface (an upper surface in FIG. 2) of the substrate 21, a conductive layer 60 (to be described in detail later) on a surface (an upper surface in FIG. 2) of the dielectric layer 25'; and a backplate side electrode 31 (to be described in detail later). The conductive layer 60 may be an n type semiconductor layer or a p type semiconductor layer formed by doping low-stress polysilicon with phosphor or boron. The dielectric layer 25' may be formed of silicon oxide such as low temperature oxide (LTO), phosphosilicate glass (PSG), and tetraethyl orthosilicate (TEOS).

The substrate 21 may have a through hole as a sound hole 33 at a center portion thereof. The substrate 21 may be a conductor material or a semiconductor material such as silicon. The sound hole 33 at the center portion of the substrate 21 of silicon material may be formed by bulk silicon etching, or the sound hole 33 may be formed into a back cavity having a post shape by dry etching. The curved beam may be located outside the sound hole 33, and a portion of the diaphragm 26 and a corresponding portion of the substrate 21 constitute a capacitor, and a projection of the portion of the diaphragm 20 on the surface of the substrate 21 is located outside an opening of the sound hole 33 on a side of the diaphragm 20.

In the illustrated examples, the diaphragm 26 is formed in a circular shape by a separating groove 50. However, the diaphragm 26 may have any appropriate shapes such as a square shape, a rectangular shape, and a polygonal shape. In addition, the sound hole 33 has a truncated prism shape in the illustrated examples, but it may have any other appropriate shapes.

In an example of the present invention, the curved beam 27 includes a plurality of sub beams, each of the plurality of sub beams has an end attached to the same curved beam support 24 fixed to the substrate 21.

Figure 5:
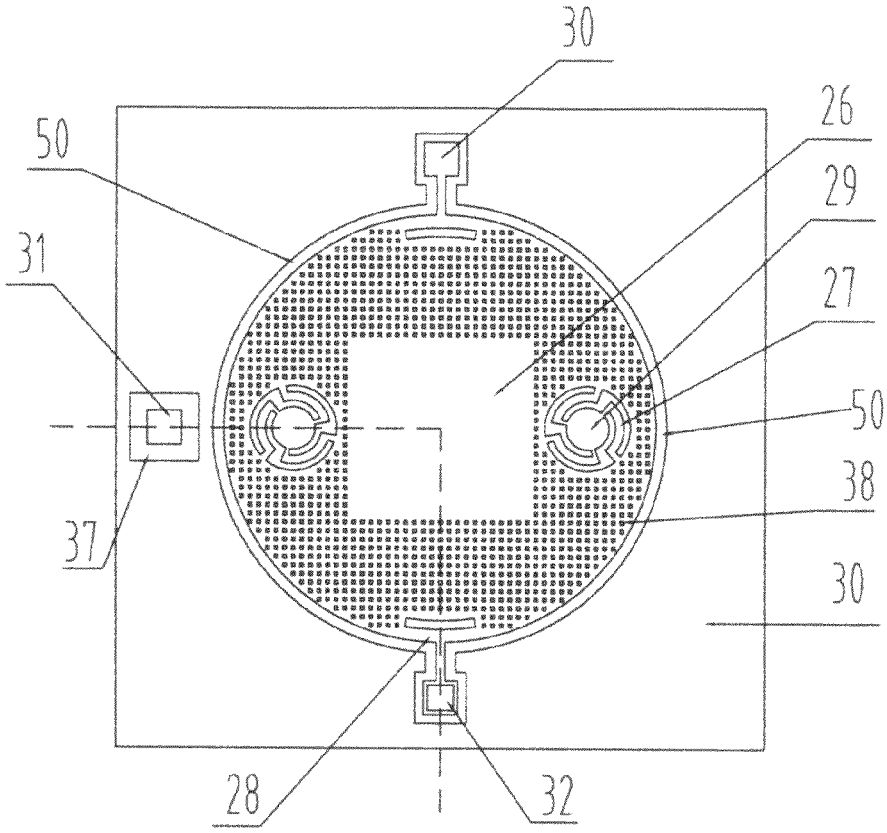
FIG. 5 is a schematic top view of a condenser microphone chip with a diaphragm supported by two curved beams and two auxiliary beams in accordance with the first embodiment of the present invention.
Figure 6:
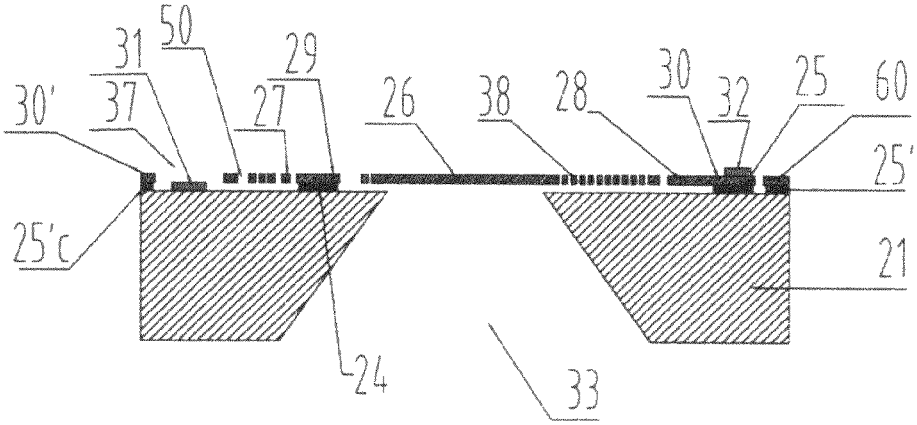
FIG. 6 is a schematic sectional view showing the condenser microphone chip with the diaphragm supported by the two curved beams and the two auxiliary beams in accordance with the first embodiment of the present invention and taken along broken lines shown in FIG. 5.
Figure 7:
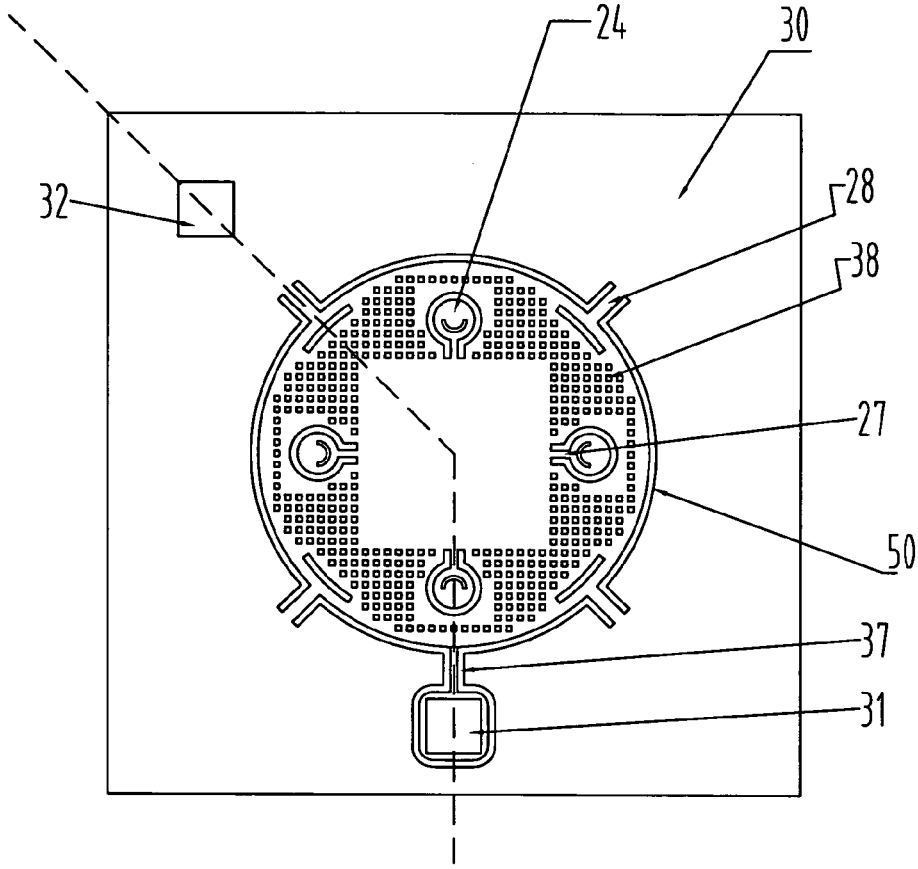
FIG. 7 is a schematic top view of a condenser microphone chip in accordance with a second embodiment of the present invention.
Figure 8:
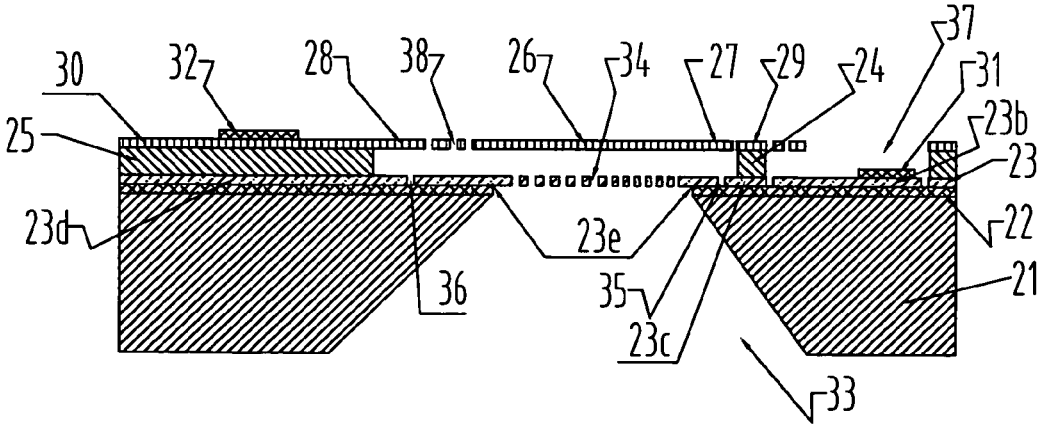
FIG. 8 is a schematic sectional view showing the condenser microphone chip in accordance with the second embodiment of the present invention and taken along broken lines shown in FIG. 7.
Figure 9:
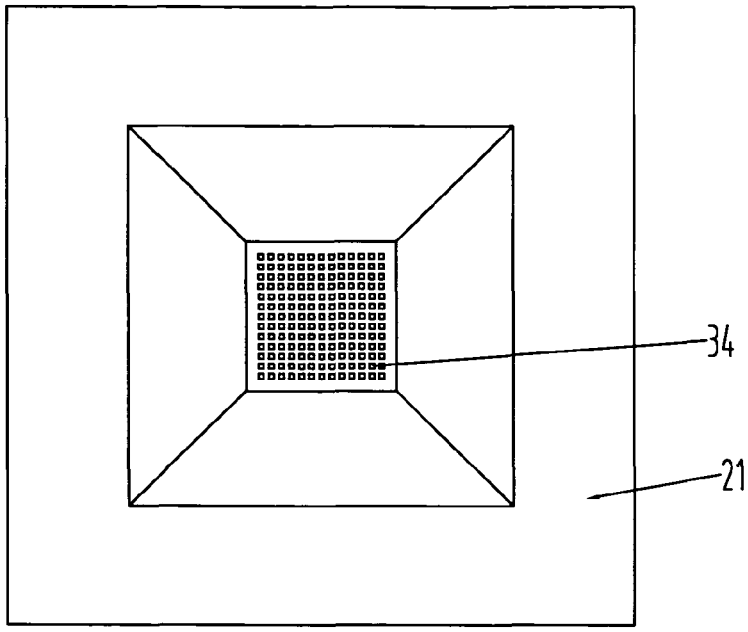
FIG. 9 is a schematic bottom view of the condenser microphone chip in accordance with the second embodiment of the present invention.
Figure 10:
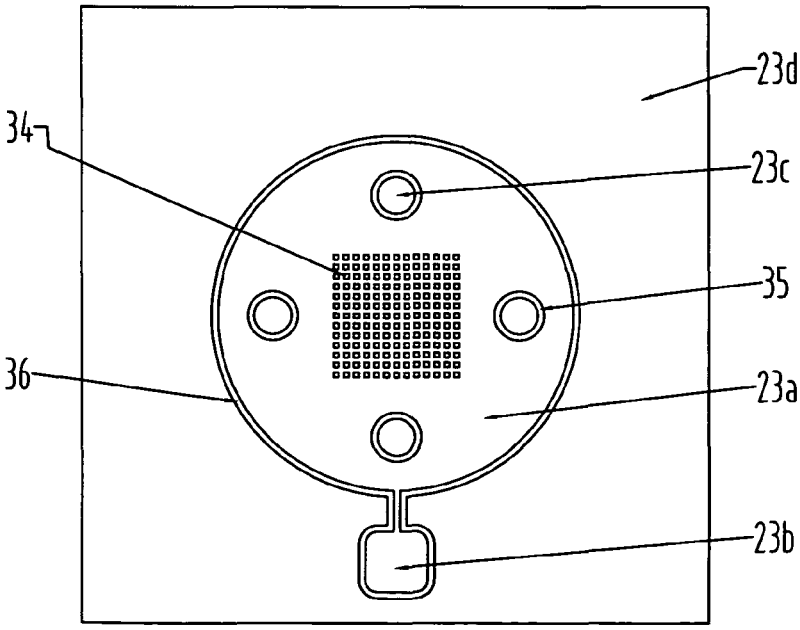
FIG. 10 is a schematic top view of a conductive layer of the condenser microphone chip in accordance with the second embodiment of the present invention.

FIGS. 1 and 5 illustrate a case that the curved beam 27 is composed of the three sub beams. It is noted that the curved beam 27 may be composed of one, two, four or more sub beams.

In an example of the present invention, the curved beam 27 comprises one curved beam 27 disposed at a substantial center portion of the diaphragm 26. In this case, the sound hole 33 may have therein one or two beams passing through a substantial center of the sound hole 33 and extending between an edge of the sound hole 33, and the two beams intersect or are perpendicular to each other. The curved beam 27 is supported on the one or two beams by the curved beam support. Alternatively, the curved beam 27 includes at least one pair of curved beams 27 arranged at substantially equal intervals and substantially symmetrical about a center of the diaphragm 26.

The condenser microphone chip according to the present invention may further comprise a curved beam connecting part 29 which is fixed to or on the curved beam support 24 and to which the curved beam 27 is connected. In the illustrated examples, the curved beam 27, the diaphragm 26 and the curved beam connecting part 29 are integrally formed.

The curved beam 27 may be arranged in the diaphragm 26. The curved beam 27 is disposed in the diaphragm 26 in FIGS. 1-6. However, the curved beam 27 may be arranged outside the diaphragm 26. In this case, the curved beam 27 has an end connected to an edge of the diaphragm 26 and another end located outside the diaphragm 26 and fixed to the substrate 21 through the curved beam support 24.

In an example of the present invention, the curved beam connecting part 29 has a shape of a substantially circular plate. The curved beam 27 is arranged in the diaphragm 26. The curved beam 27 each includes a plurality of sub beams, each of the plurality of sub beams including a first sub beam portion extending in a substantially radial direction (or radially) from a circumference of the curved beam connecting part 29; a second sub beam portion extending in a substantially circumferential direction (or around the circumference) from an end of the first sub beam portion away from the circumference of the curved beam connecting part 29 and having a shape of a substantial arc; and a third sub beam portion extending in the radial direction (or radially) from an end of the second sub beam portion away from the first sub beam portion and connected to the diaphragm 26.

The second sub beam portions of the plurality of the sub beams of the curved beam 27 may extend toward an identical circumferential direction from the ends of the first sub beam portions away from the circumference of the curved beam connecting part 29. However, the second sub beam portions of the plurality of the sub beams of the curved beam 27 may extend toward opposite circumferential directions from the ends of the first sub beam portions away from the circumference of the curved beam connecting part 29. For example, in a case that the curved beam 27 comprises four or six sub beams, the second sub beam portions of the adjacent two sub beams of the curved beam 27 may extend toward two circumferential directions toward or away from each other from the ends of the respective first sub beam portions away from the circumference of the curved beam connecting part 29, and the first sub beam portions of the curved beam 27 may be correspondingly positioned. In addition, the plurality of the sub beams of the curved beam 27 may have a substantially identical shape or different shapes. The plurality of the sub beams of the curved beam 27 may be arranged at substantially equal intervals around the circumference of the curved beam connecting part 29.

In an example of the present invention, the condenser microphone chip may further comprise an auxiliary beam 28. The auxiliary beam 28 includes: a first portion configured by forming an opening in the diaphragm 26 at a predetermined distance from an edge of the diaphragm 26, the first portion having two ends connected with the diaphragm 26; and a second portion extending from the first portion away from the diaphragm 26, the second portion being fixed at an end of the second portion away from the first portion to the substrate 21, for example, by an auxiliary beam support 25 fixed to the substrate 21.

In another example of the present invention, the auxiliary beam 28 includes a first elongated portion configured by forming an opening in the diaphragm 26 substantially parallel to the edge of the diaphragm 26 at a predetermined distance from the edge, the first portion having two ends connected with the diaphragm 26; and a second elongated portion extending away from the diaphragm 26 from a substantially middle portion of the first portion, the second portion being fixed to the substrate 21 at an end of the second portion away from the first portion, for example, by the auxiliary beam support 25, and the first portion and the second portion being formed in a "T" shape together, as shown in FIG. 1.

Figure 3:
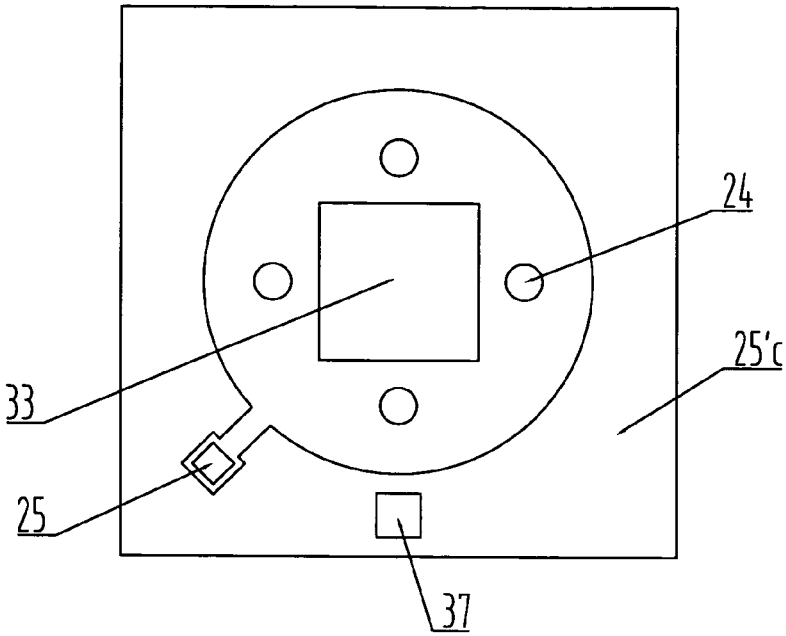
FIG. 3 is a schematic top view of a dielectric layer of the condenser microphone chip with the diaphragm supported by the four curved beams and the one auxiliary beam in accordance with the first embodiment of the present invention.
Figure 4:
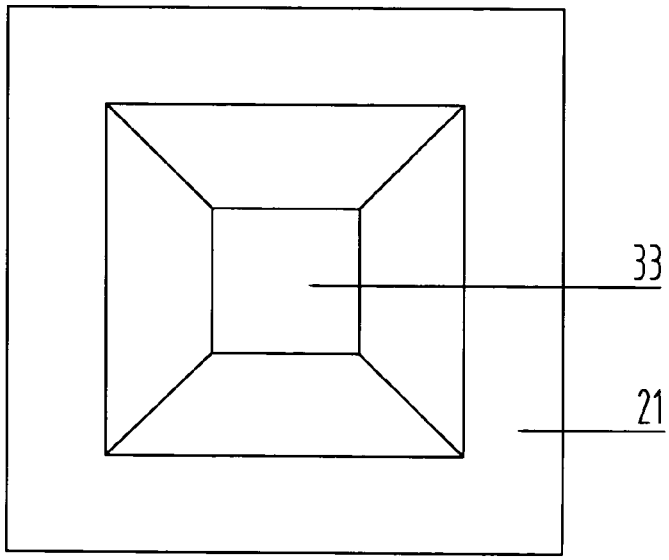
FIG. 4 is a schematic bottom view of the condenser microphone chip with the diaphragm supported by the four curved beams and the one auxiliary beam in accordance with the first embodiment of the present invention.

The dielectric layer 25' comprises the curved beam support 24, the auxiliary beam support 25 and a surrounding dielectric layer 25'*c*, as shown in FIG. 3. The surrounding dielectric layer 25'*c* may be formed in a ring shape, and the curved beam support 24 and the auxiliary beam support 25 may be arranged within the ring-shaped surrounding dielectric layer 25'*c* and be separated from each other. The opening of the sound hole 33 on the side of the diaphragm 20 is located within the surrounding dielectric layer 25'*c* in the illustrated examples.

In the illustrated examples, a through hole is disposed on a side of the ring-shaped surrounding dielectric layer 25'*c* above the surrounding dielectric layer 25'*c* to serve as a backplate side electrode hole 37. A metal electrode as a backplate side electrode 31 is fixed to the surface (an upper surface in FIGS. 2 and 6) of the substrate 21. The backplate side electrode 31 may be made of gold or aluminum.

The conductive layer 60 comprises the diaphragm 26, the curved beam 27, the auxiliary beam 28, the curved beam connecting part 29, the auxiliary beam connecting part 30 and a surrounding conductive layer 30', as shown in FIG. 1. The diaphragm 26 is positioned within a circular range of the surround dielectric layer 25'*c*. The diaphragm 26 may be connected at an inner portion thereof to the curved beam connecting part 29 through the inner curved beam 27, and the curved beam connecting part 29 may be fixed to a surface (an upper surface in FIGS. 2 and 6) of the curved beam support 24.

In the illustrated examples, the edge of the diaphragm 26 is connected to the auxiliary beam connecting part 30 through the auxiliary beam 28, and the auxiliary beam connecting part 30 is fixed on a surface (an upper surface in FIGS. 2 and 6) of the auxiliary beam support 25. The auxiliary beam 28 accomplishes a function of supporting the diaphragm and serves as a lead wire for the electrode. The auxiliary beam 28 may be configured in many structures, and preferably may extend in the "T" shape, since the beam extending in the "T" shape can well release stress in the diaphragm in a certain space. Residual stress in the diaphragm can be sufficiently released since it is supported by the soft curved beam 27 and the auxiliary beam 28. The curved beam 27 serves as a spring, and thus can effectively prevent attachment of the diaphragm to the backplate and improve reliability of the condenser microphone chip.

In the illustrated examples, the diaphragm 26 covers the opening of the sound hole 33 on the side of the diaphragm 26 and has an area larger than that of the opening of the sound hole 33. A portion of the diaphragm 26 and a corresponding portion of the substrate 21 constitute a capacitor, and a projection of the portion of the diaphragm 26 on the surface of the substrate 21 is located outside the opening of the sound hole 33 on the side of the diaphragm 26. A plurality of small holes 38 are disposed in the aforesaid portion of the diaphragm 26. The metal electrode as the diaphragm side electrode 32 is fixed on the surface (the upper surface in FIGS. 2 and 6) of the auxiliary beam connecting part 30. The diaphragm side electrode 32 may be made of gold or aluminum. The surrounding conductive layer 30' is fixed on the surrounding dielectric layer 25'*c*, and the former and the latter have the same shape. The diaphragm 26 formed by the separating groove 50 may be circular, square, or polygonal in shape.

In the examples shown in FIGS. 1-6, the diaphragm 26 is circular in shape, and the opening for forming the first portion of the auxiliary beam 28 is an are slit parallel to the edge of the diaphragm 26, so that the first portion is a beam portion extending in an arc shape, and the second portion is a straight-line-shaped beam portion extending in the radial direction of the diaphragm 26 from the middle portion of the first portion. However, when the diaphragm has a polygonal shape, the opening may be parallel to a side of the polygonal diaphragm, and the first portion and the second portion may be formed in the "T" shape together. In the above examples, the opening is parallel to the edge of the diaphragm, but apparently the opening may be nonparallel to the edge of the diaphragm. For example, the opening may be positioned at any appropriate angle with respect to the edge of the diaphragm. In addition, the shape of the first portion and the second portion are not limited to the "T" shape, and they can be configured at any appropriate angle with respect to each other. In addition, in the above examples, the second portion extends from the middle portion of the first portion, but the present invention is not limited thereto. The second portion may extend from the other positions of the first portion, such as a portion between the middle portion and an end of the first portion.

In an example of the present invention, the end of the curved beam 27 is connected to the curved beam support 24, and the diaphragm side electrode 32 is attached to the end of the curved beam 27 connected to the curved beam support 24 so as to be electrically connected with the diaphragm 26. Alternatively, the diaphragm side electrode 32 may be disposed at the curved beam connecting part 29, or may be electrically connected with the diaphragm 26 in other manners.

In the illustrated examples, the auxiliary beam connecting part 30 is connected to the auxiliary beam support 25, and the end of the second portion of the auxiliary beam 28 is coupled to the auxiliary beam connecting part 30.

In an example of the present invention, the diaphragm side electrode 32 may be attached to the end of the second portion of the auxiliary beam 28 connected to the auxiliary beam support 25 so as to be electrically connected with the diaphragm 26, or the diaphragm side electrode 32 may be attached to the auxiliary beam connecting part 30 connected to the auxiliary beam support 25 so as to be electrically connected with the diaphragm 26.

In the illustrated examples, the substrate 21 and the diaphragm 26 form a plate type capacitor with an air gap of 2-5 μm therebetween. When sound wave acts on the diaphragm 26, the diaphragm 26 transmits a force applied to the diaphragm to the curved beam 27 and the auxiliary beam 28 so that the curved beam and the auxiliary beam deform. Since deformation mainly occurs at the curved beam 27 and the auxiliary beam 28, the diaphragm 26 easily vibrates in a direction perpendicular to a surface of the diaphragm. As a result, an amount of displacement of the diaphragm is converted into a change in capacitance to achieve a function of a sensor. Since the diaphragm 26 almost translates when the diaphragm 26 vibrates due to the sound wave, mechanical sensitivity of the diaphragm 26 can be sufficiently used. Since the present invention employs the curved beams disposed in the diaphragm so that the vibration all over the diaphragm 26 is substantially of translation, the diaphragm 26 is not easily attached to the substrate 21 as compared with the prior arts with identical sensitivity. Therefore, the curved beams disposed in the diaphragm improve rate of finished products and reliability of the chip to a great extent.

Second Embodiment

The second embodiment according to the present invention will be described hereinafter with reference to FIGS. 7 through 20.

Referring to FIGS. 7 to 20, a condenser microphone chip according to a second embodiment of the present invention comprises: a substrate 21; a backplate 23*a* connected with the substrate 21; a diaphragm 26 spaced from the backplate 23*a*, for example, by a predetermined distance; and a curved beam 27 connected with the diaphragm 26 to anchor the diaphragm 26 to the substrate 21. The diaphragm 26 and the backplate 23*a* may be formed of conductive layers. The backplate 23*a* may be suspended only at a center portion thereof. The condenser microphone chip may further comprise a dielectric layer 22 disposed on a surface (an upper surface in FIG. 8) of the substrate 21, a conductive layer 23 disposed on a surface of the dielectric layer 22, another dielectric layer 25' disposed on a surface of the conductive layer 23, and a backplate side electrode 31 (to be described in detail later). The substrate 21 and the dielectric layer 22 have a through hole as a sound hole or a back cavity 33. The substrate 21 may be made of semiconductor material such as silicon. The sound hole 33 at the center portion of the substrate 21 of silicon material may be formed by bulk silicon etching, or the sound hole 33 may be formed into a back cavity having a post shape by dry etching. The dielectric layer 22 is fixed to or on a surface (an upper surface in FIG. 8) of the substrate 21, and may be formed of semiconductor material such as silicon oxide or silicon nitride.

In the illustrated examples, the conductive layer 23 is attached to or fixed on the dielectric layer 22 and comprises the backplate 23*a*, a lead wire 23*b* for the electrode, a support partition 23*c* and a surround layer 23*d*. The backplate 23*a* is disposed at an middle region of the conductive layer 23 and has a center region as a suspended region 23*e* directly opposite an opening (an upper opening in FIG. 8) of the sound hole 33 on a side of the conductive layer 23. In other words, the suspended region 23*e* of the backplate 23*a* is opposite to the sound hole 33 of the substrate 21. A plurality of suspended region sound holes 34 are formed in the suspended region 23*e*. A region of the backplate 23*a* except the region of the backplate 23*a* directly opposing the sound hole 33 is fixedly attached to the dielectric layer 22. The backplate 23*a* is attached to the lead wire 23*b* and is electrically isolated from the support partition 23*c* by a separating groove 35. The support partition 23*c* may have shapes such as a circular shape, a rectangular shape, and a polygonal shape. The backplate 23*a* is electrically isolated from the surrounding layer 23*d* by a separating groove 36. The backplate 23*a* may have any appropriate shapes such as a square shape, a rectangular shape, a circular shape, and a polygonal shape. The conductive layer 23 may be an n type semiconductor layer or a p type semiconductor layer formed by doping polysilicon with phosphor or boron. The backplate 23*a* in the conductive layer 23 serves as a plate of a capacitor.

In the illustrated examples, the diaphragm 26 is formed in a circular shape by a separating groove 50. Apparently, the diaphragm 26 may have any other appropriate shapes such as a square shape, a rectangular shape, and a polygonal shape. In addition, the sound hole 33 has a truncated prism shape in the illustrated examples, but it may have any other appropriate shapes.

The curved beam may extend in one of a substantial "S" shape, a shape of a substantial arc, and a substantial helical shape.

In an example of the present invention, the curved beam 27 comprises one curved beam 27 disposed at a substantial center portion of the diaphragm 26. In this case, the sound hole 33 may have therein one or two beams passing through a substantial center of the sound hole 33 and extending between an edge of the sound hole 33, and the two beams intersect or are perpendicular to each other. The curved beam 27 is supported on the one or two beams by the curved beam support. Alternatively, the curved beam 27 includes at least one pair of curved beams 27 arranged at substantially equal intervals and substantially symmetrical about a center of the diaphragm 26.

The condenser microphone chip according to the present invention may further comprise a curved beam connecting part 29 which is fixed to a curved beam support 24 (to be described in detail later) and to which the curved beam 27 is connected. In the illustrated examples, the curved beam 27, the diaphragm 26 and the curved beam connecting part 29 are integrally formed. In addition, the curved beam may be formed within the diaphragm 26.

In an example of the present invention, the curved beam connecting part 29 of the condenser microphone chip has a shape of a substantially circular plate. The curved beam 27 is arranged in the diaphragm 26. The curved beam 27 includes a plurality of sub beams, each of the plurality of sub beams including a first sub beam portion extending in a substantially radial direction (or radially) from a circumference of the curved beam connecting part 29; a second sub beam portion extending in a substantially circumferential direction (or around the circumference) from an end of the first sub beam portion away from the circumference of the curved beam connecting part 29 and having a shape of a substantial arc; and a third sub beam portion extending in the radial direction (or radially) from an end of the second sub beam portion away from the first sub beam portion and connected to the diaphragm 26.

The second sub beam portions of the plurality of the sub beams of the curved beam 27 may extend toward an identical circumferential direction from the ends of the first sub beam portions away from the circumference of the curved beam connecting part 29. However, the second sub beam portions of the plurality of the sub beams of the curved beam 27 may extend toward opposite circumferential directions from the ends of the first sub beam portions away from the circumference of the curved beam connecting part 29. For example, in a case that the curved beam 27 comprises four or six sub beams, the second sub beam portions of the adjacent two sub beams of the curved beam 27 may extend toward two circumferential directions toward or away from each other from the ends of the respective first sub beam portions away from the circumference of the curved beam connecting part 29, and the first sub beam portions of the curved beam 27 may be correspondingly positioned. In addition, the plurality of the sub beams of the curved beam 27 may have a substantially identical shape or different shapes. The plurality of the sub beams of the curved beam 27 may be arranged at substantially equal intervals around the circumference of the curved beam connecting part 29.

In an example of the present invention, the condenser microphone chip may further comprise an auxiliary beam 28. The auxiliary beam 28 includes: a first portion configured by forming an opening in the diaphragm 26 at a predetermined distance from an edge of the diaphragm 26, the first portion having two ends connected with the diaphragm 26; and a second portion extending from the first portion away from the diaphragm 26, the second portion being fixed at an end of the second portion away from the first portion to the substrate 21, for example, by an auxiliary beam support 25 fixed to the substrate 21.

In another example of the present invention, the auxiliary beam 28 includes a first elongated portion configured by forming an opening in the diaphragm 26 substantially parallel to the edge of the diaphragm 26 at a predetermined distance from the edge, the first portion having two ends connected with the diaphragm 26; and a second elongated portion extending away from the diaphragm from a substantially middle portion of the first portion, the second portion being fixed at an end of the second portion away from the first portion to the substrate 21, for example, by the auxiliary beam support 25, and the first portion and the second portion being formed in a "T" shape together. The second elongated portion of the auxiliary beam may be attached to an auxiliary beam connecting part 30 connected with the auxiliary beam support 25.

In the illustrated examples, the curved beam support 24 and the auxiliary beam support 25 are fixedly attached to the conductive layer 23. Specifically, the curved beam support 24 is fixedly attached to the support partition 23*c*. The curved beam connecting part 29 is fixed on the curved beam support 24, while the auxiliary beam support 25 is fixed on the surrounding layer 23*d*. A through hole 37 is disposed on a side of the auxiliary beam support 25 so that a projection of an edge of the through hole 37 on the conductive layer 23 is outside an edge of the lead wire 23*b*. The backplate side electrode 31 is disposed to a surface (an upper surface in FIG. 8) of the lead wire 23*b* in the through hole 37. The curved beam support 24 and the auxiliary beam support 25 are insulator formed of silicon oxide such as LTO, PSG, and TEOS or other materials.

The diaphragm 26 and the backplate 23*a* may substantially correspond in shape to each other and be directly opposite to each other in a direction perpendicular to a surface of the diaphragm. The diaphragm 26 is located within the auxiliary beam connecting part 30, and may be connected to the curved beam connecting part 29 and the auxiliary beam connecting part 30 through the curved beam 27 and the auxiliary beam 28, respectively. The curved beam 27 and the auxiliary beam 28 can be formed in many shapes.

In the illustrated examples, the curved beam 27 and the auxiliary beam 28 extend in a "T" shape. The beams extending in the "T" shape can well release stress in the diaphragm in a limited space. There is a gap of 2-4 μm between the diaphragm 26 and the backplate 23*a*. A plurality of small holes 38 are disposed in a portion of the diaphragm 26 outside a range of a projection of an opening of the sound hole 33, which projection is on a surface of the diaphragm 26 and which opening is on a side of the diaphragm 26. The curved beam connecting part 29, the auxiliary beam connecting part 30, the curved beam 27, the auxiliary beam 28, and diaphragm 26 may be formed of conductive material, or may be made of be an n type semiconductor layer or a p type semiconductor layer formed by doping polysilicon with phosphor or boron.

In an example of the present invention, the condenser microphone chip further comprises a diaphragm side electrode 32 which is attached to an end of the curved beam 27 connected to the curved beam support 24 so as to be electrically connected with the diaphragm 26. Alternatively, the diaphragm side electrode 32 may be disposed at the curved beam connecting part 29 or electrically connected with the diaphragm 26 in other appropriate manners.

In an example of the preset invention, the diaphragm side electrode 32 may be attached to the auxiliary beam connecting part 30 connected to the auxiliary beam support 25 so as to be electrically connected with the diaphragm 26.

Figure 11:
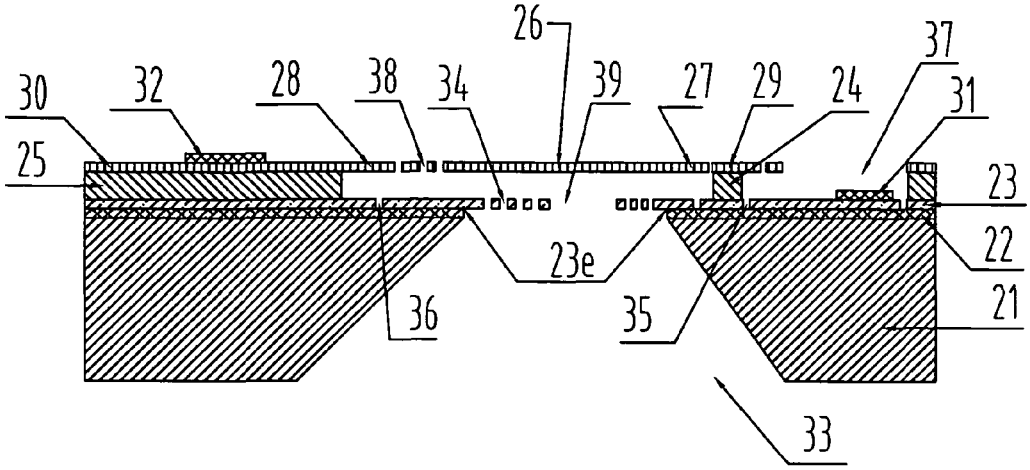
FIG. 11 is a schematic sectional view showing a condenser microphone chip with a hole located at a suspended region in accordance with the second embodiment of the present invention and taken along the broken lines shown in FIG. 7.
Figure 12:
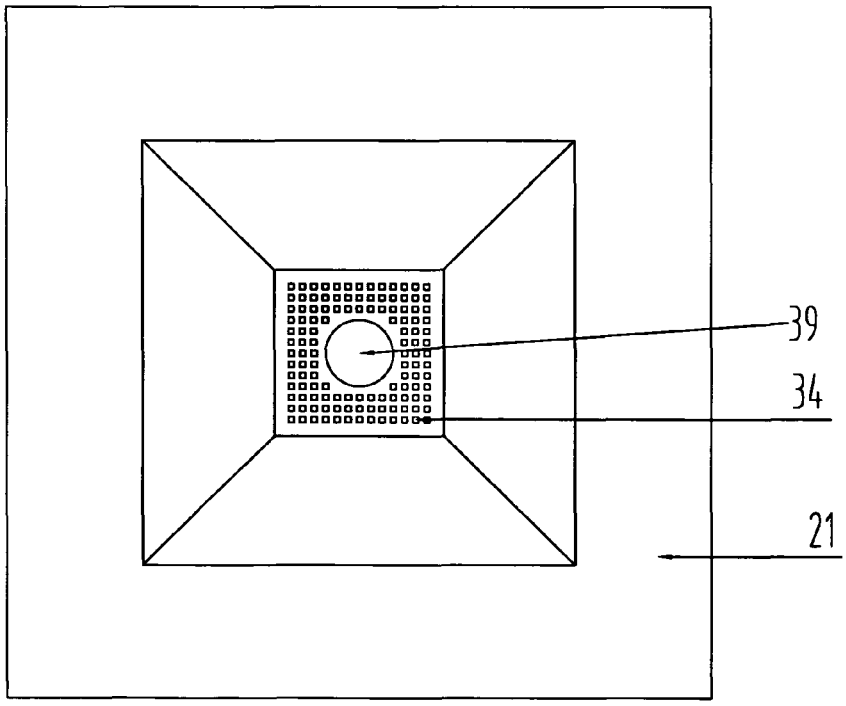
FIG. 12 is a schematic bottom view of the condenser microphone chip with the hole located at the suspended region in accordance with the second embodiment of the present invention.
Figure 13:
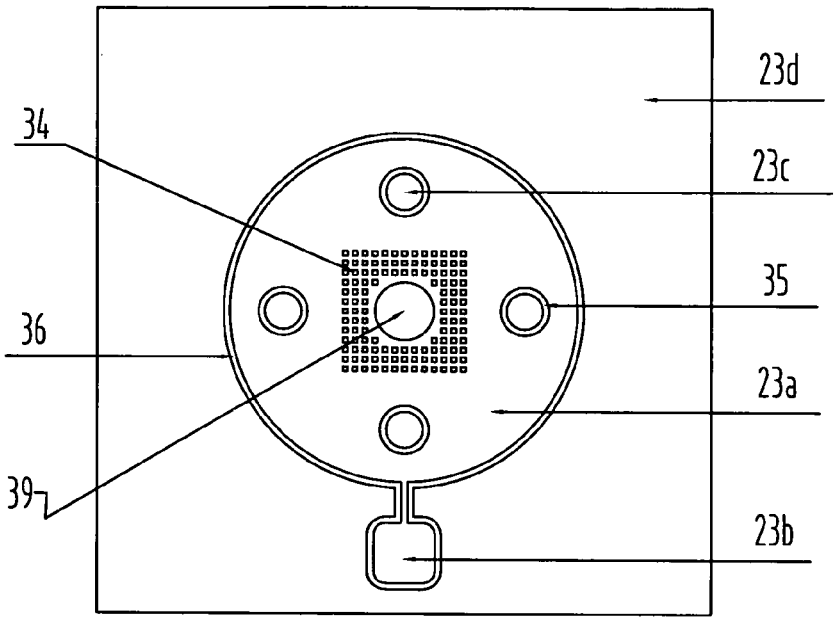
FIG. 13 is a schematic top view of a conductive layer of the condenser microphone chip with the hole located at the suspended region in accordance with the second embodiment of the present invention.

In an example of the present invention, the condenser microphone chip further comprises an opening 39 formed in the suspended region 23*e*. The suspended region sound holes 34 are not formed in a region of the suspended region 23*e* where the opening 39, a backplate beam connecting part 23*g* (to be described in detail later), and a plurality of backplate beams 23*f* (to be described in detail later) are formed. The opening 39 of the suspended region 23*e* may be located at a center of the suspended region 23, and may be square, circular, or polygonal, as shown in FIGS. 11-13.

In an example of the present invention, the condenser microphone chip further comprises a reinforcing rib connected with the backplate 23*a* for reinforcing stiffness of the backplate 23*a*. In the illustrated examples, since a part of the backplate 23*a* forms the suspended region 23*e*, the reinforcing rib is mainly used to increase stiffness of the suspended region 23*e* of the backplate 23*a*. The reinforcing rib may be disposed at the suspended region 23*e* of the backplate 23*a* without number of process steps increased.

In an example of the preset invention, the reinforcing rib is connected with the backplate 23*a* and extends from a position outside the suspended region 23*e* to the suspended region 23*e* or toward a center of the suspended region 23*e*.

In the illustrated examples, the reinforcing rib extends to a vicinity of the center of the suspended region 23*e*. Apparently, the reinforcing rib may extend across the suspended region 23*e* from a position to another position outside the suspended region 23*e*.

In an example of the present invention, the diaphragm 26 has an opening located to correspond to the reinforcing rib; and the reinforcing rib protrudes from the backplate 23*a* into the opening of the diaphragm 26 with a slit 42 formed between the reinforcing rib and an edge of the opening.

Figure 14:
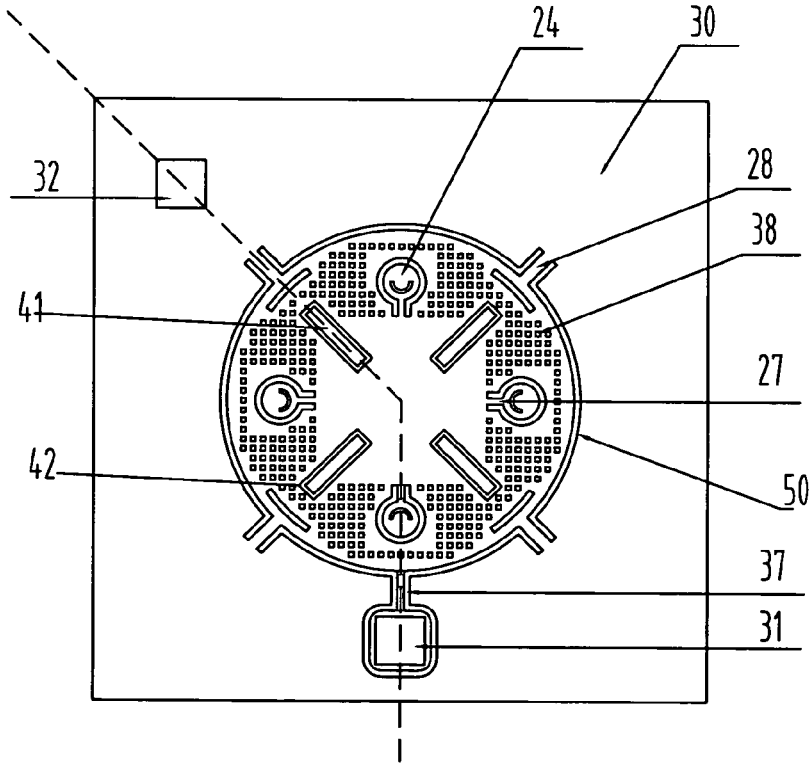
FIG. 14 is a schematic top view of a condenser microphone chip with reinforcing ribs disposed at a suspended region in accordance with the second embodiment of the present invention.
Figure 15:
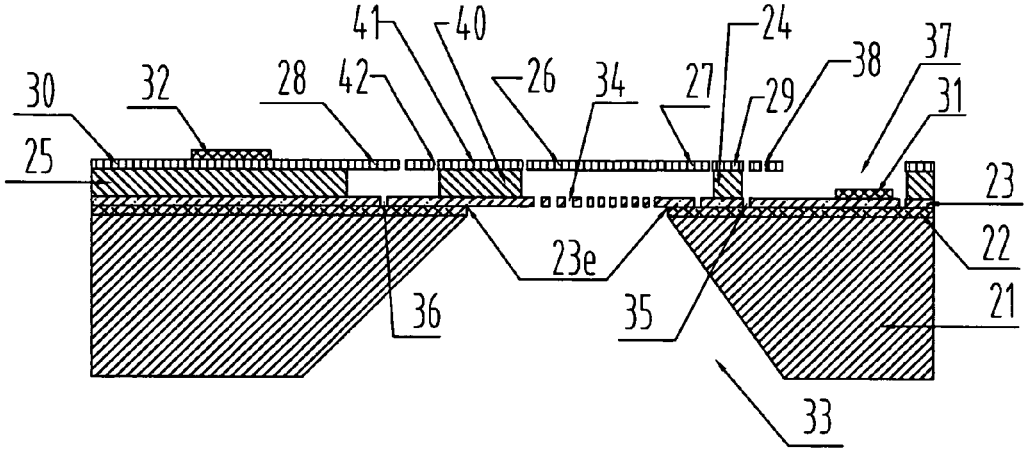
FIG. 15 is a schematic sectional view showing the condenser microphone chip with the reinforcing ribs disposed at the suspended region in accordance with the second embodiment of the present invention and taken along broken lines shown in FIG. 14.
Figure 16:
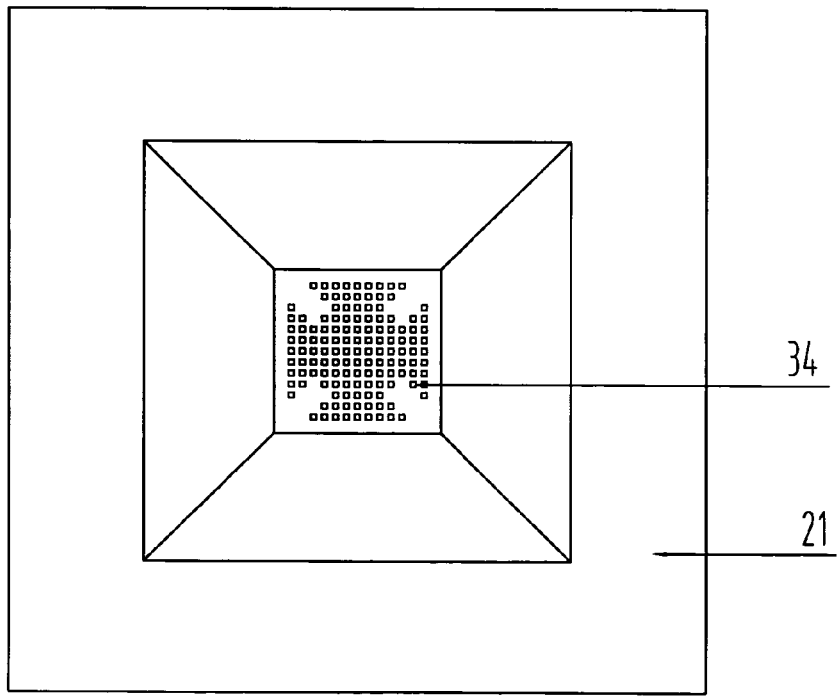
FIG. 16 is a schematic bottom view of the condenser microphone chip with the reinforcing ribs disposed at the suspended region in accordance with the second embodiment of the present invention.
Figure 17:
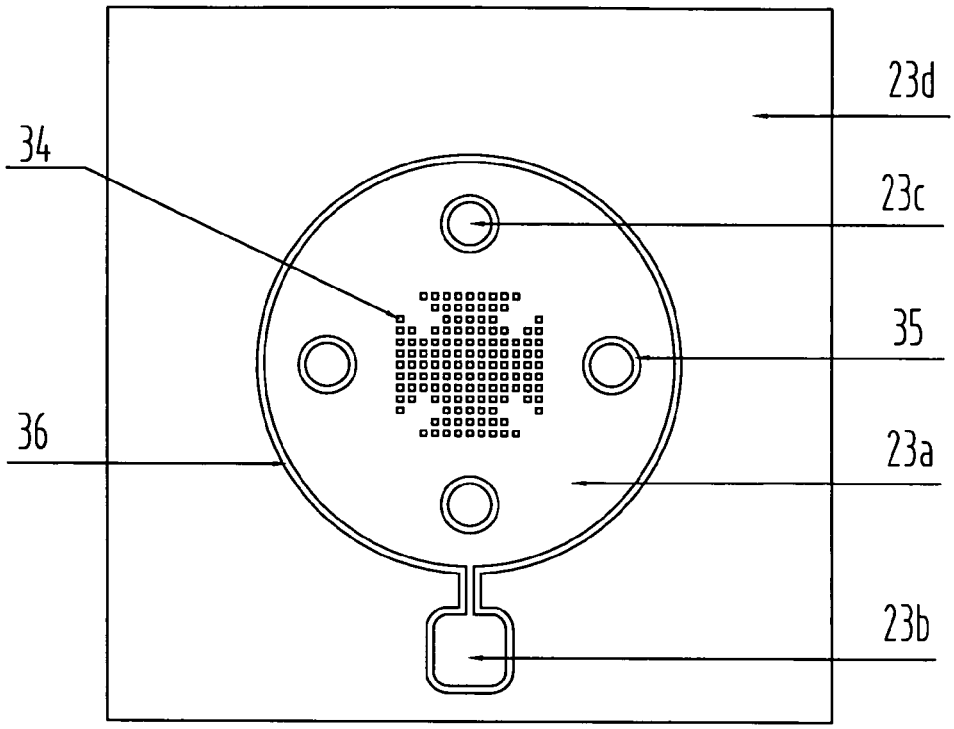
FIG. 17 is a schematic top view of a conductive layer of the condenser microphone chip with the reinforcing ribs disposed at the suspended region in accordance with the second embodiment of the present invention.

The reinforcing rib may comprise four reinforcing ribs arranged at substantially equal intervals and substantially symmetrical about the center of the suspended region 23*e*, as shown in FIG. 14.

The reinforcing rib comprises a dielectric strip 40 located in the same layer as the curved beam support 24, and a conductive strip 41 fixed to the dielectric strip 40 and located in the same layer as the diaphragm 26. Alternatively, the reinforcing rib may comprise only the dielectric strip 40.

In addition, the reinforcing rib may be formed on a side of the suspended region 23*e* near the substrate 21. Furthermore, the reinforcing rib may be formed of the dielectric layer 22 or a separate material. In this case, the diaphragm 26 does not necessarily have the opening positioned to correspond to the reinforcing rib.

Figure 18:
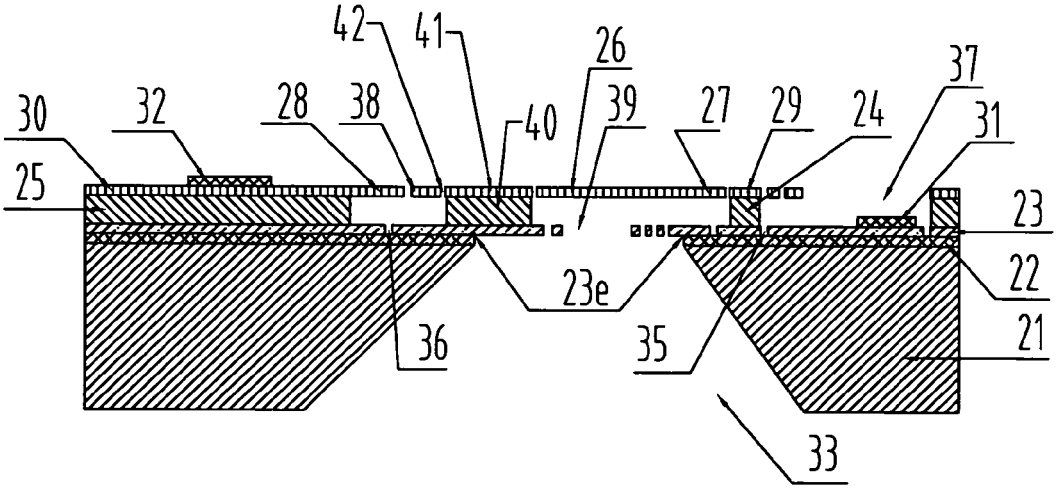
FIG. 18 is a schematic sectional view showing a condenser microphone chip with reinforcing ribs and a hole disposed at a suspended region in accordance with the second embodiment of the present invention and taken similar to FIG. 15.
Figure 19:
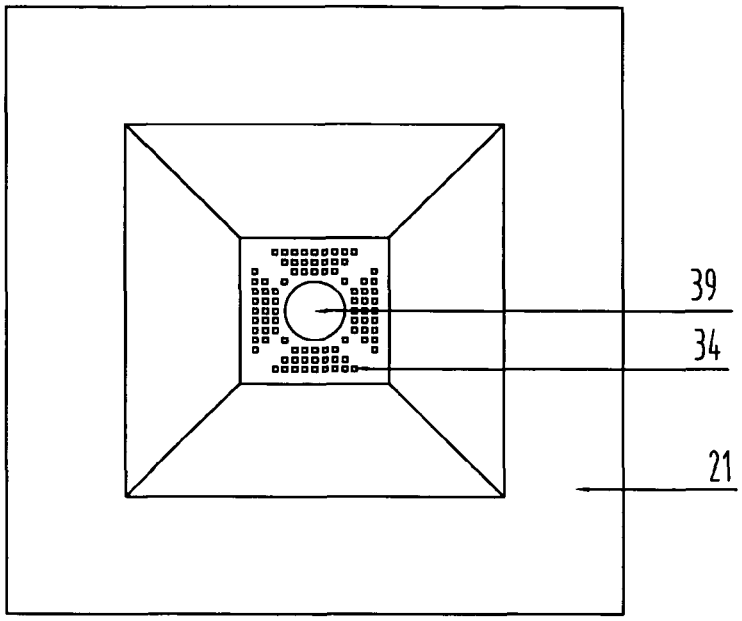
FIG. 19 is a schematic bottom view of the condenser microphone chip with the reinforcing ribs and the hole disposed at the suspended region in accordance with the second embodiment of the present invention.
Figure 20:
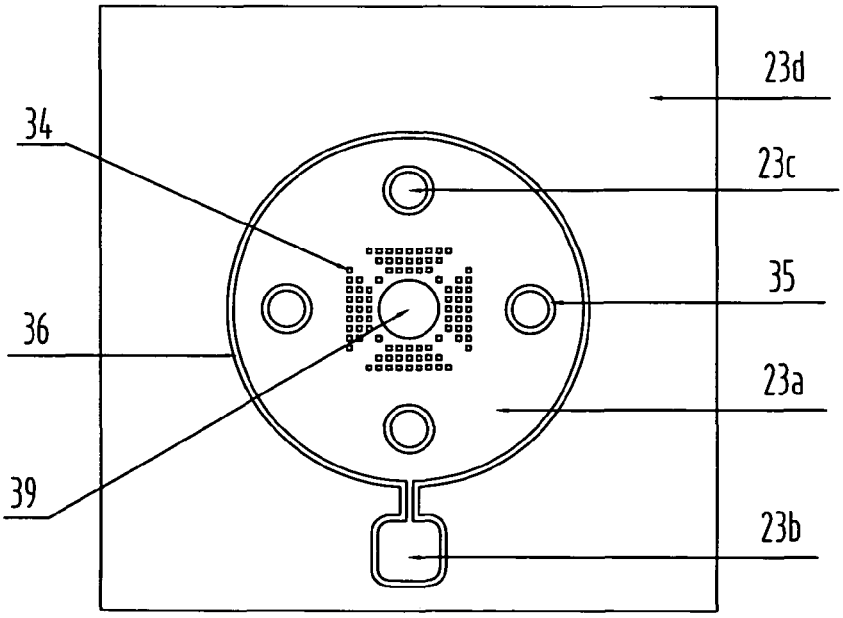
FIG. 20 is a schematic top view of a conductive layer of the condenser microphone chip with the reinforcing ribs and the hole disposed at the suspended region in accordance with the second embodiment of the present invention.

FIGS. 14-17 show a structure in which a reinforcing rib is provided at a suspended region 23*e* and the suspended region 23*e* do not have a hole 39 at a center portion thereof, while FIGS. 18-20 show a structure in which a reinforcing rib is provided at a suspended region 23*e* and the suspended region 23*e* has a hole 39 at a center portion thereof. In the illustrated examples, the dielectric strip 40 and the conductive strip 41 are radially disposed across an edge of the region 23*e*. The dielectric strip 40 is located in the same layer as the curved beam support 24 and the auxiliary support 25, and formed of the same material as the curved beam support 24 and the auxiliary support 25, the material may be silicon oxide such as LTO, PSG, and TEOS or other materials. The conductive strip 41 is attached to the dielectric strip 40 and is located in the same layer as the diaphragm 26, and formed of the same material as the diaphragm 26. A slit 42 is formed between the conductive strip 41 and the diaphragm 26.

In the illustrated examples, the backplate 23*a* and the diaphragm 26 form a plate type capacitor. When sound wave acts on the diaphragm 26, the diaphragm 26 transmits a force applied to the diaphragm to the curved beam 27 and the auxiliary beam 28 so that the curved beam and the auxiliary beam deform. Since deformation mainly occurs at the curved beam 27 and the auxiliary beam 28, the diaphragm easily vibrates in the direction perpendicular to the surface of the diaphragm. As a result, an amount of displacement of the diaphragm 26 is converted into a change in capacitance to achieve a function of a sensor. Since the vibration all over the diaphragm 26 is generally of translation, the diaphragm 26 is not easily attached to the substrate 21 as compared with that of the prior art with the same sensitivity. Therefore, rate of finished products and reliability of the chip are improved to a great extent. With a configuration in which a part of the backplate 23*a* is suspended, stiffness of the suspended structure is increased, and the chip can be made smaller in the case that the backplate has identical size.

Third Embodiment

The third embodiment according to the present invention will be described hereinafter with reference to FIGS. 21 through 28 and 7 through 20.

Referring to FIGS. 21 to 28 and 7-20, a condenser microphone chip according to a third embodiment of the present invention comprises: a substrate 21 having a through hole 33; a backplate 23*a* connected with the substrate 21 and having a suspended region 23*e* opposing the through hole 33 of the substrate 21; a diaphragm 26 spaced from the backplate 23*a*, for example, by a predetermined distance; and a supporting member 24' supported between the diaphragm 26 and the suspended region 23*e*. A predetermined region of the suspended region 23*e* around the supporting member 24' has a stiffness lower than that of the other region of the suspended region 23*e*.

With the above configuration, the supporting member 24' can prevent the diaphragm 26 from being attached to the backplate 23*a*, and at the same time resistance to vibration of the diaphragm 26 due to the supporting member 24' can be minimized.

Figure 21:
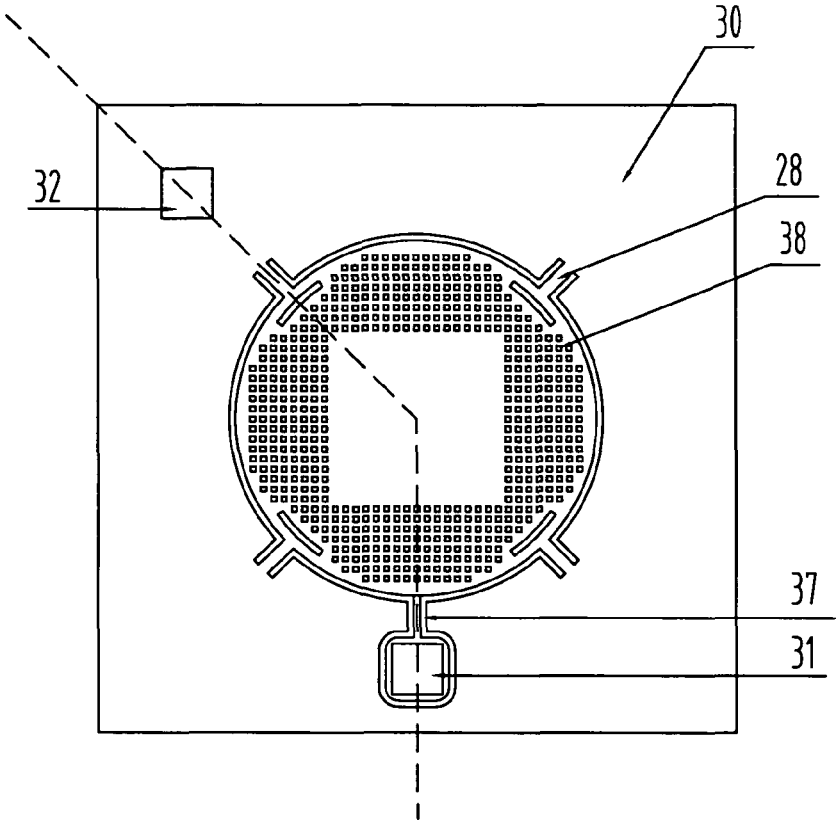
FIG. 21 is a schematic top view of a condenser microphone chip in accordance with a third embodiment of the present invention.
Figure 22:
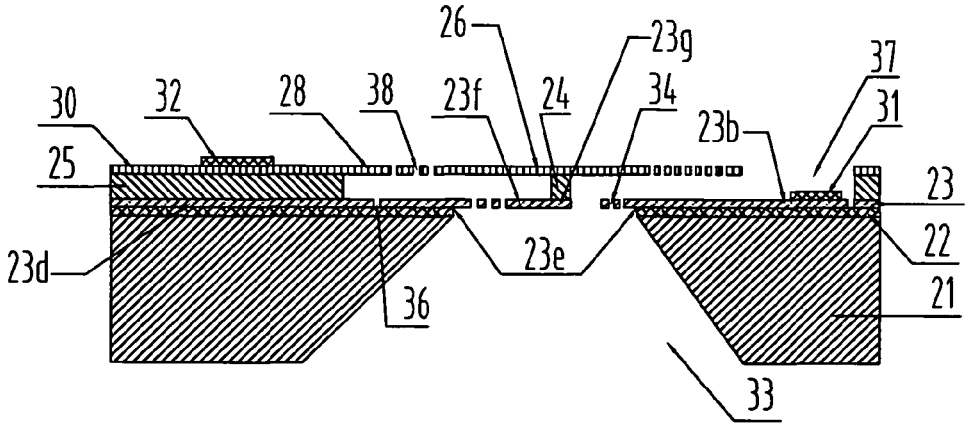
FIG. 22 is a schematic sectional view showing the condenser microphone chip in accordance with the third embodiment of the present invention and taken along broken lines shown in FIG. 21.
Figure 23:
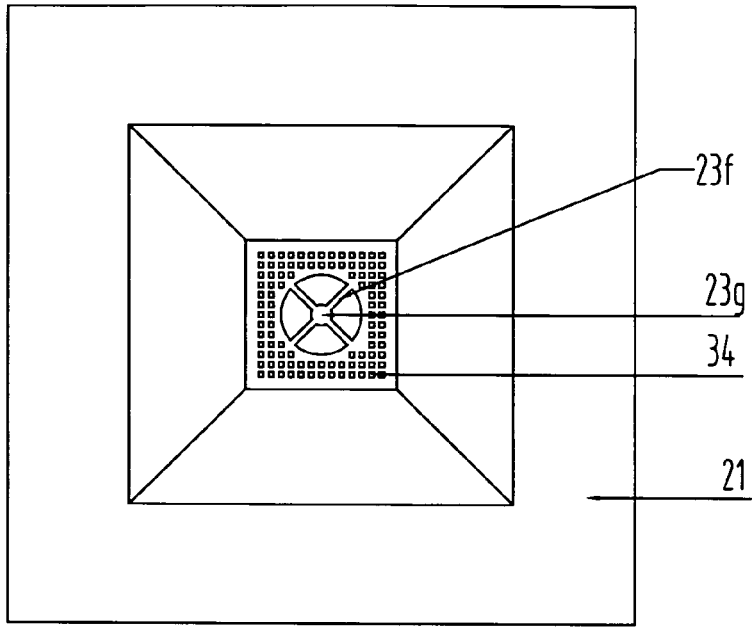
FIG. 23 is a schematic bottom view of the condenser microphone chip in accordance with the third embodiment of the present invention.

In the illustrated examples, only one supporting member 24' is shown, but a plurality of supporting member 24' can be used and arranged at substantially equal intervals and substantially symmetrical about a center of the suspended region 23*e*. In addition, the suspended region 23*e* may comprise a plurality of suspended region sound holes 34. The backplate may be suspended only at a center region thereof, as shown in FIGS. 21 and 22. The condenser microphone chip may further comprise a dielectric layer 22 disposed on a surface (an upper surface in FIG. 22) of the substrate 21, a conductive layer 23 disposed on a surface of the dielectric layer 22, another dielectric layer 25' disposed on a surface of the conductive layer 23, and a backplate side electrode 31 (to be described in detail later). The substrate 21 and the dielectric layer 22 have the through hole as a sound hole or a back cavity 33.

Figure 24:
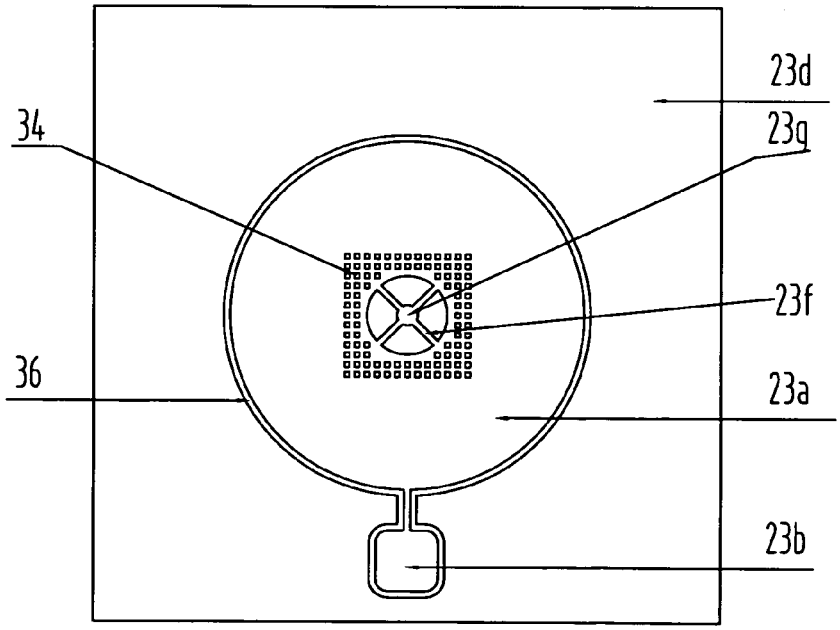
FIG. 24 is a schematic top view of a conductive layer of the condenser microphone chip in accordance with the third embodiment of the present invention.

The substrate 21 may be made of semiconductor material such as silicon. The sound hole 33 at the center portion of the substrate 21 of silicon material may be formed by bulk silicon etching, or the sound hole 33 may be formed into a back cavity having a post shape by dry etching. The dielectric layer 22 is fixed to a surface (an upper surface in FIG. 22) of the substrate 21, and may be formed of semiconductor material such as silicon oxide or silicon nitride. The conductive layer 23 is fixed on the dielectric layer 22, as shown in FIG. 24. The supporting member 24' is fixed on the conductive layer 23, as shown in FIG. 20.

In an example of the present invention, the condenser microphone chip may further comprise a curved beam 27 connected with the diaphragm 26 to anchor the diaphragm 26 to the substrate 21. The curved beam 27 may extend in one of a substantial "S" shape, a shape of a substantial arc, and a substantial helical shape. Apparently, the curved beam 27 may extend in any other appropriate curved shapes. The curved beam 27 may be formed within the diaphragm 26.

In an example of the present invention, the curved beam 27 includes at least one pair of curved beams 27 arranged at substantially equal intervals and substantially symmetrical about a center of the diaphragm 26.

In an example of the present invention, the condenser microphone chip further comprises a curved beam connecting part 29 with which the curved beam 27 is connected at an end thereof and which is attached to a curved beam support 24 fixed to the substrate 21.

In an example of the present invention, the curved beam connecting part 29 of the condenser microphone chip has a shape of a substantially circular plate. The curved beam 27 is arranged in the diaphragm 26. The curved beam 27 includes a plurality of sub beams, each of the plurality of sub beams including a first sub beam portion extending in a substantially radial direction (or radially) from a circumference of the curved beam connecting part 29; a second sub beam portion extending in a substantially circumferential direction (or around the circumference) from an end of the first sub beam portion away from the circumference of the curved beam connecting part 29 and having a shape of a substantial arc; and a third sub beam portion extending in the radial direction (or radially) from an end of the second sub beam portion away from the first sub beam portion and connected to the diaphragm 26.

The second sub beam portions of the plurality of the sub beams of the curved beam 27 may extend toward an identical circumferential direction from the ends of the first sub beam portions away from the circumference of the curved beam connecting part 29. However, the second sub beam portions of the plurality of the sub beams of the curved beam 27 may extend toward opposite circumferential directions from the ends of the first sub beam portions away from the circumference of the curved beam connecting part 29. For example, in a case that the curved beam 27 comprises four or six sub beams, the second sub beam portions of the adjacent two sub beams of the curved beam 27 may extend toward two circumferential directions toward or away from each other from the ends of the respective first sub beam portions away from the circumference of the curved beam connecting part 29, and the first sub beam portions of the curved beam 27 may be correspondingly positioned. In addition, the plurality of the sub beams of the curved beam 27 may have a substantially identical shape or different shapes. The plurality of the sub beams of the curved beam 27 may be arranged at substantially equal intervals around the circumference of the curved beam connecting part 29.

In an example of the present invention, the condenser microphone chip may further comprise an auxiliary beam 28. The auxiliary beam 28 includes: a first portion configured by forming an opening in the diaphragm 26 at a predetermined distance from an edge of the diaphragm 26, the first portion having two ends connected with the diaphragm 26; and a second portion extending from the first portion away from the diaphragm 26, the second portion being fixed at an end of the second portion away from the first portion to the substrate 21, for example, by an auxiliary beam support 25. The auxiliary beam support 25 is fixedly disposed on the conductive layer 23 as shown in FIG. 22.

Figure 25:
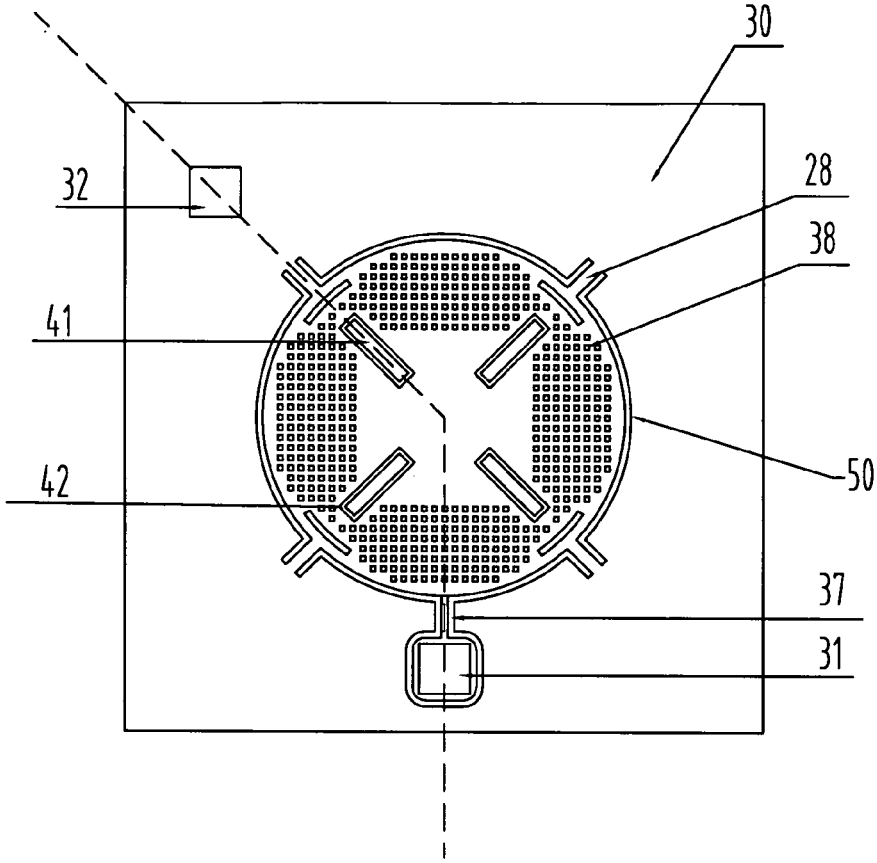
FIG. 25 is a schematic top view of a condenser microphone chip with reinforcing ribs disposed at a suspended region in accordance with the third embodiment of the present invention.

In another example of the present invention, the auxiliary beam 28 includes a first elongated portion configured by forming an opening in the diaphragm 26 substantially parallel to the edge of the diaphragm 26 at a predetermined distance from the edge, the first portion having two ends connected with the diaphragm 26; and a second elongated portion extending away from the diaphragm 26 from a substantially middle portion of the first portion, the second portion being fixed at an end of the second portion away from the first portion to the substrate 21, for example, by the auxiliary beam support 25, and the first portion and the second portion being formed in a "T" shape together, as shown in FIG. 25. The second portion of the auxiliary beam 28 may be fixed at the end of the second portion away from the first portion to the auxiliary beam support 25 by an auxiliary beam connecting part 30.

In an example of the present invention, the condenser microphone chip further comprises a diaphragm side electrode 32 which is attached to the end of the curved beam 27 connected to the curved beam support 24 so as to be electrically connected with the diaphragm 26. Alternatively, the diaphragm side electrode 32 may be attached to the end of the second portion of the auxiliary beam 28 connected with the auxiliary beam support 25 or to the auxiliary beam connecting part 30 so as to be electrically connected with the diaphragm 26.

In an example of the present invention, the condenser microphone chip further comprises a reinforcing rib connected with the backplate 23*a* for reinforcing stiffness of a region of the backplate 23*a* except the predetermined region of the suspended region 23*e*. The reinforcing rib may be disposed at the suspended region 23*e* of the backplate 23*a* without number of process steps increased.

In another example of the preset invention, the reinforcing rib is connected with the backplate 23*a* and extends from a position outside the suspended region 23*e* to the suspended region 23*e* or toward a center of the suspended region 23*e*.

In an example of the present invention, the diaphragm 26 has an opening located to correspond to the reinforcing rib; and the reinforcing rib protrudes from the backplate 23*a* into the opening of the diaphragm 26 with a slit 42 formed between the reinforcing rib and an edge of the opening.

The reinforcing rib may comprise four reinforcing ribs arranged at substantially equal intervals and substantially symmetrical about the center of the suspended region 23*e*.

Figure 26:
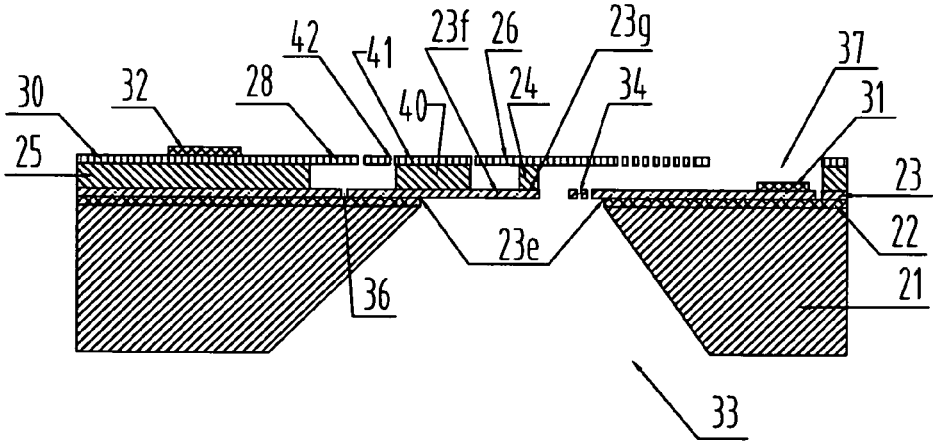
FIG. 26 is a schematic sectional view showing the condenser microphone chip with the reinforcing ribs disposed at the suspended region in accordance with the third embodiment of the present invention and taken along broken lines shown in FIG. 25.
Figure 27:
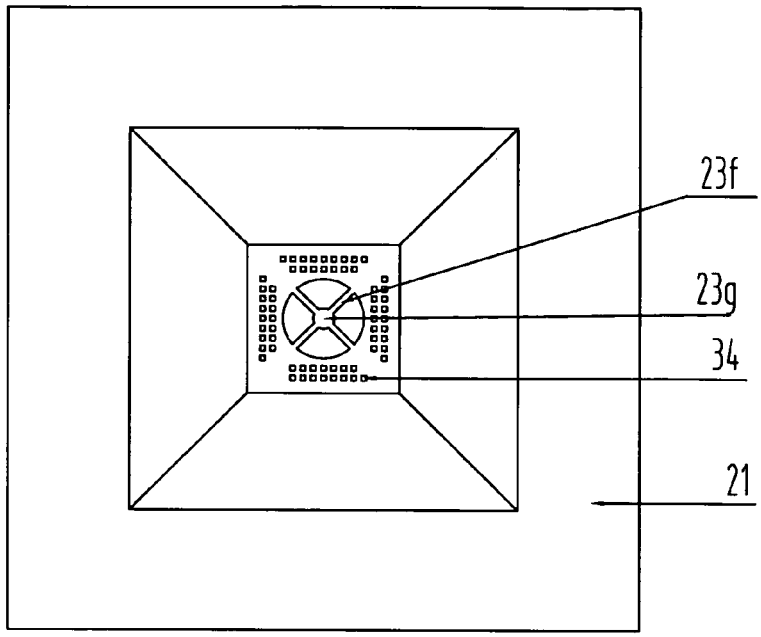
FIG. 27 is a schematic bottom view of the condenser microphone chip with the reinforcing ribs disposed at the suspended region in accordance with the third embodiment of the present invention.
Figure 28:
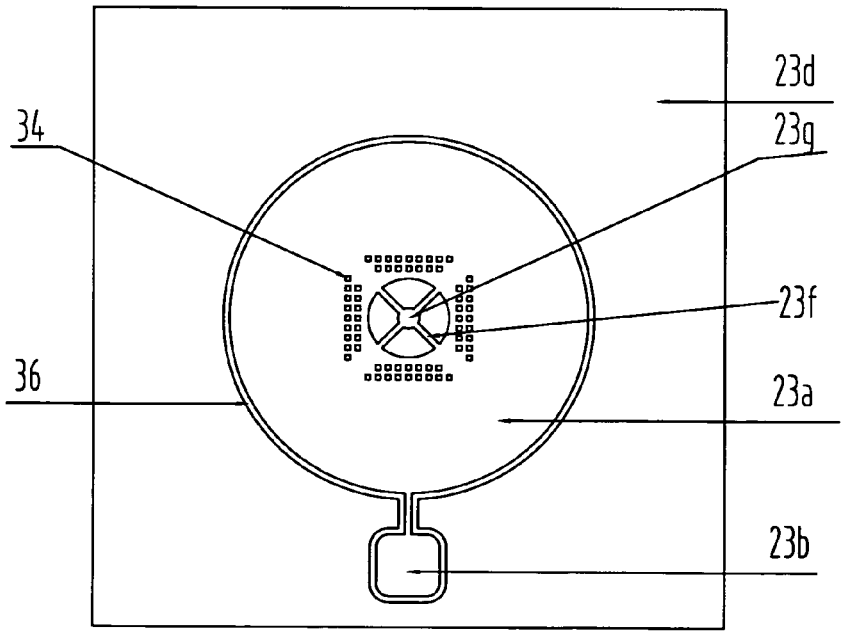
FIG. 28 is a schematic top view a conductive layer of the condenser microphone chip with the reinforcing ribs disposed at the suspended region in accordance with the third embodiment of the present invention.

The reinforcing rib may comprises a dielectric strip 40 located in the same layer as the curved beam support 24, and a conductive strip 41 fixed to the dielectric strip 40 and located in the same layer as the diaphragm 26, as shown in FIG. 26. The dielectric strip 40 is radially disposed on the suspended region 23*e* across an edge of the suspended region 23*e* and the conductive strip 41 is disposed on the dielectric strip 40. The dielectric strip 40, the supporting member 24', and the auxiliary beam support 25 are located in the same layer and made of the same material such as silicon oxide such as LTO, PSG, and TEOS. The conductive strip 41 is fixed on the dielectric strip 40, the conductive strip 41 and the diaphragm 26 are located in the same layer and formed of the same material, and there is the slit 42 between the edge of the opening of the diaphragm and the conductive strip 41.

The supporting member 24' may be supported between the diaphragm 26 and the suspended region 23*e* at the center portion of the suspended region 23*e*.

In an example of the present invention, the predetermined low-stiffness region of the suspended region comprises: an opening formed at the center portion of the suspended region 23*e*, a backplate beam connecting part 23*g* located at a center portion of the opening, and a plurality of backplate beams 23*f* connected between the backplate beam connecting part 23*g* and an edge of the opening. The backplate beam connecting part 23*g* may have a square shape, a circular shape, a polygonal shape, or any other appropriate shapes. In addition, the opening may have a square shape, a circular shape, a polygonal shape, or any other appropriate shapes. The backplate beam 23*f* may be a straightline-shaped beam.

In the illustrated examples, the backplate 23*a* is formed in a shape of a frame, and a center of the center opening of the backplate 23*a* is aligned with a center of an opening of the back cavity or sound hole 33 on a side of the backplate 23*a*. A region of backplate 23*a* is the suspended region 23*e*, and a projection of the region of the backplate 23*a* on the substrate 21 is within the opening of the sound hole 33. The other region of the backplate 23*a* is fixed on the dielectric layer 22, and a projection of the other region of the backplate 23*a* on the substrate 21 is outside the opening of the back cavity 33.

The plurality of backplate beams 23*f* may comprise four backplate beams 23*f* arranged at substantially equal intervals and substantially symmetrical about the center of the suspended region 23*e*. The supporting member 24' is supported at the center portion of the suspended region 23*e* between the diaphragm 26 and the backplate beam connecting part 23*g* of the suspended region 23*e*.

The conductive layer 23 comprises the backplate 23*a*, a lead wire 23*b*, the backplate beam connecting part 23*g*, a surround layer 23*d*, and backplate beams 23*f*, as shown in FIG. 24.

Referring to FIGS. 21-22, the backplate beam connecting part 23*g* is located at the center portion of the center opening of the ring-shaped backplate 23*a*, and the four backplate beams 23*f* are disposed at equal intervals around a periphery of the backplate beam connecting part 23*g*. Each of the four backplate beams 23*f* has an end connected to the backplate beam connecting part 23*g*, and another end attached to the inner edge of the center hole of the backplate 23*a*. The backplate beam 23*f* can be formed in many structures although it is illustrated as a straight-line beam. The backplate 23*a* is connected with the electrode lead wire 23*b* and electrically isolated from the surrounding layer 23*d* by a separating groove 36. The backplate 23*a* in the conductive layer 23 serves as a plate of a capacitor. The conductive layer 23 may be formed of polysilicon, and preferably an n type semiconductor conductive layer or a p type semiconductor conductive layer formed by doping the polysilicon with phosphor or boron. The backplate 23*a* may be square, circular, or polygonal in shape.

The auxiliary beam support 25 is fixed on the surrounding layer 23*d*, and a through hole 37 is disposed on a side of the auxiliary beam support 25 so that a projection of an edge of the through hole 37 on the conductive layer 23 is outside an edge of the lead wire 23*b*. The backplate side electrode 31 is disposed on an upper surface of the lead wire 23*b* in the through hole 37. The supporting member 24' and the auxiliary beam support 25 are insulator formed of silicon oxide such as LTO, PSG, and TEOS or other materials.

In the illustrated examples, the diaphragm 26 and the backplate 23*a* may be substantially identical in shape with each other and be aligned with each other in a direction perpendicular to a surface of the diaphragm. The diaphragm 26 is located within the auxiliary beam connecting part 30, and may be connected at a center portion of the diaphragm without a hole to an upper end of the supporting member 24'. The edge of the diaphragm 26 is connected to the auxiliary beam connecting part 30 through the auxiliary beam 28, and the auxiliary beam 28 may be configured in many structures. In the illustrated examples, the auxiliary beam 28 extends in a "T" shape. The beams extending in the "T" shape can accomplish a good stress releasing effect in a limited space. There is a gap of 2-4 μm between the diaphragm 26 and the backplate 23*a*. A plurality of small holes 38 are disposed in a portion of the diaphragm 26 outside a range of a projection of the opening of the sound hole 33, which projection is on a surface of the diaphragm 26 and which opening is on a side of the diaphragm 26. The auxiliary beam connecting part 30, the auxiliary beam 28, and diaphragm 26 may be formed of conductive material, or may be made of be an n type semiconductor layer or a p type semiconductor layer formed by doping polysilicon with phosphor or boron. The diaphragm side electrode 32 is disposed on a side on the auxiliary beam connecting part 30.

In the illustrated examples, the backplate 23*a* and the diaphragm 26 form a plate type capacitor. When sound wave acts on the diaphragm 26, the diaphragm 26 transmits a force applied to the diaphragm to the auxiliary beam 28 and the backplate beam 23*f* so that the auxiliary beam 28 and the backplate beam 23*f* deform. Since deformation mainly occurs at the auxiliary beam 28 and the backplate beam 23*f*, the diaphragm easily vibrates in the direction perpendicular to the surface of the diaphragm. As a result, an amount of displacement of the vibration of the diaphragm is converted into a change in capacitance to achieve a function of a sensor. The vibration all over the diaphragm 26 is generally of translation. Therefore, the diaphragm 26 is not easily attached to the substrate 21 in the case of identical sensitivity. Therefore, rate of finished products of the chip is improved to a great extent. With a configuration in which a part of the backplate 23*a* is suspended, stiffness of the suspended structure is increased, and the chip can be made smaller with the same size of the backplate.

A method for manufacturing a condenser microphone chip according to the present invention will be described hereinafter.

The condenser microphone chips are made by MEMS (Micro-electro-mechanical system) in many ways such as the following specific one.

The condenser microphone chip according to the first embodiment of the present invention, as shown in FIGS. 1 through 6, is manufactured by following steps.

1. A low resistance silicon wafer with a first side and a second side polished is selected as a substrate 21. Silicon nitride films of a thickness of 3000 Å grow on the two sides of the silicon wafer by low pressure chemical vapor deposition (LPCVD) process, respectively.

2. The silicon nitride film on the first side of the silicon wafer is removed by reactive ion etching, and the silicon nitride film on the second side of the silicon wafer is partially etched by the reactive ion etching. The etched region is to serve as a window for corroding the silicon wafer.

3. A layer of silicon oxide such as PSG, LTO, and TEOS of a thickness of 3 μm grows on the first side as a sacrificial layer and a supporting layer.

4. Low stress polysilicon layers of a thickness of 1 μm further grow on the first side and the second side of the silicon wafer by LPCVD process, so that n type or p type polysilicon layers are formed by injection or diffusion.

5. A pattern design for the polysilicon layer on the first side is etched by reactive ion etching to form a diaphragm, beams, and the like.

6. The layer of silicon oxide such as PSG, LTO, and TEOS is corroded to be perforated by HF solution to form a backplate side electrode hole.

7. A metal electrode is made on the first side of the silicon wafer by sputtering, evaporation, or plating.

8. The polysilicon layer on the second side of the silicon wafer is firstly removed by washing the silicon wafer with potassium hydroxide (KOH) and then the substrate is corroded up to the layer of silicon oxide such as PSG, LTO, and TEOS to form a sound hole by bulk silicon etching while the first side of the silicon wafer is protected.

9. The layer of silicon oxide such as PSG, LTO, and TEOS under the diaphragm is corroded to be removed by HF solution through small holes located in a portion of the diaphragm outside the sound hole and the sound hole. Size of beam connecting parts is far larger than that between the small holes, so that beam supports beneath the beam connecting parts can be formed by appropriately controlling time of the corrosion.

Furthermore, a manufacturing process for the condenser microphone chip according to the second embodiment of the present invention, as shown in FIGS. 7 through 20, is substantially identical with the above process except the following difference.

The following steps are added prior to growing the silicon nitride films in the above step 1:

a. Dielectric layers of silicon dioxide of a thickness of 3000 Å are formed on the two sides of the silicon wafer by thermal oxidation.

b. The dielectric layer of silicon dioxide on the first side is removed while the first side of the silicon wafer is protected.

The following steps are added between the steps 2 and 3:

c. Low stress polysilicon layers of a thickness of 2 μm further grow on the first side and the second side of the silicon wafer by LPCVD process, so that n type or p type polysilicon layers are formed by injection or diffusion.

d. A pattern design for the polysilicon layer on the first side is etched by reactive ion etching.

Finally, a manufacturing process for the condenser microphone chip according to the third embodiment of the present invention, as shown in FIGS. 21 through 28, is substantially identical with the above process for the condenser microphone chip according to the second embodiment of the present invention.

It will be understood that the present invention may be embodied in other specific forms without departing from the spirit or principle thereof. The present examples and the embodiments, therefore, are to be considered as illustrative and not restrictive, and the invention is not to be limited to the details given herein.

For example, some of the above features, structures and components in the above embodiments and examples may be combined to form various embodiments and examples, unless the combination is impracticable. Therefore, any combination of the above-described elements in all possible variations thereof is encompassed by the invention unless otherwise indicated herein or otherwise clearly contradicted by context.

In addition, the use of the terms "a" and "an" and "the" and similar referents in the context of describing the invention (especially in the context of the following claims) are to be construed to cover both the singular and the plural, unless otherwise indicated herein or clearly contradicted by context.

What is claimed is:

1. A condenser microphone chip, comprising:

a substrate;

a diaphragm spaced from the substrate;

a curved beam connected with the diaphragm to anchor the diaphragm to the substrate; and a curved beam connecting part having a shape of a substantially circular plate, wherein the curved beam is arranged in the diaphragm, and wherein each curved beam includes a plurality of sub beams, each of the plurality of sub beams including a first sub beam portion extending in a substantially radial direction from a circumference of the curved beam connecting part; a second sub beam portion extending in a substantially circumferential direction from an end of the first sub beam portion away from the circumference of the curved beam connecting part and having a shape of a substantial arc; and a third sub beam portion extending in the radial direction from an end of the second sub beam portion away from the first sub beam portion and connected to the diaphragm.

2. The condenser microphone chip according to claim 1, wherein:

the curved beam includes one curved beam disposed at a substantial center portion of the diaphragm.

3. The condenser microphone chip according to claim 1, wherein the curved beam includes at least one pair of curved beams arranged at substantially equal intervals and substantially symmetrical about a center of the diaphragm.

4. The condenser microphone chip according to claim 1, further comprising:

an auxiliary beam including a first portion configured by forming an opening in the diaphragm at a predetermined distance from an edge of the diaphragm, the first portion having two ends connected with the diaphragm; and a second portion extending from the first portion away from the diaphragm, the second portion being fixed to the substrate at an end of the second portion away from the first portion.

5. The condenser microphone chip according to claim 1, further comprising:

a curved beam support which is fixed to the substrate and to which the curved beam is connected at an end of the curved beam; and a diaphragm side electrode which is attached to the end of the curved beam connected to the curved beam support so as to be electrically connected with the diaphragm.

6. The condenser microphone chip according to claim 4, further comprising:

an auxiliary beam support fixed to the substrate, the end of the second portion of the auxiliary beam being fixed to the substrate by connecting to the auxiliary beam support; and a diaphragm side electrode which is attached to the end of the second portion of the auxiliary beam connected to the auxiliary beam support so as to be electrically connected with the diaphragm.

7. The condenser microphone chip according to claim 1, wherein the curved beam extends in one of a substantial "S" shape, a shape of a substantial arc, and a substantial helical shape.

8. A condenser microphone chip, comprising:

a substrate;

a backplate connected with the substrate;

a diaphragm spaced from the backplate;

a curved beam connected with the diaphragm to anchor the diaphragm to the substrate; and a curved beam connecting part having a shape of a substantially circular plate, wherein the curved beam is arranged in the diaphragm, and wherein each curved beam includes a plurality of sub beams, each of the plurality of sub beams including a first sub beam portion extending in a substantially radial direction from a circumference of the curved beam connecting part; a second sub beam portion extending in a substantially circumferential direction from an end of the first sub beam portion away from the circumference of the curved beam connecting part and having a shape of a substantial arc; and a third sub beam portion extending in the radial direction from an end of the second sub beam portion away from the first sub beam portion and connected to the diaphragm.

9. The condenser microphone chip according to claim 8, wherein:

the curved beam includes one curved beam disposed at a substantial center portion of the diaphragm.

10. The condenser microphone chip according to claim 8, wherein the curved beam includes at least one pair of curved beams arranged at substantially equal intervals and substantially symmetrical about a center of the diaphragm.

11. The condenser microphone chip according to claim 8, further comprising:

an auxiliary beam including a first portion configured by forming an opening in the diaphragm at a predetermined distance from an edge of the diaphragm, the first portion having two ends connected with the diaphragm; and a second portion extending from the first portion away from the diaphragm, the second portion being fixed to the substrate at an end of the second portion away from the first portion.

12. The condenser microphone chip according to claim 11, further comprising:

an auxiliary beam support fixed to the substrate, the end of the second portion of the auxiliary beam being fixed to the substrate by connecting to the auxiliary beam support; and a diaphragm side electrode which is attached to the end of the second portion of the auxiliary beam connected to the auxiliary beam support so as to be electrically connected with the diaphragm.

13. The condenser microphone chip according to claim 8, further comprising:

a curved beam support which is fixed to the substrate and to which the curved beam is connected at an end of the curved beam; and a diaphragm side electrode which is attached to the end of the curved beam connected to the curved beam support so as to be electrically connected with the diaphragm.

14. The condenser microphone chip according to claim 8, wherein the substrate has a through hole, and the backplate has a suspended region opposing the through hole of the substrate.

15. The condenser microphone chip according to claim 14, further comprising:

an opening located at a center of the suspended region.

16. The condenser microphone chip according to claim 14, further comprising:

a reinforcing rib connected with the backplate for reinforcing a stiffness of the backplate.

17. The condenser microphone chip according to claim 14, further comprising:

a supporting member supported between the diaphragm and the suspended region, wherein a predetermined region of the suspended region around the supporting member has a stiffness lower than that of the other region of the suspended region.

18. The condenser microphone chip according to claim 17, wherein the predetermined region of the suspended region comprises:

an opening formed at a center portion of the suspended region, a backplate beam connecting part located at a center portion of the opening, and a plurality of backplate beams connected between the backplate beam connecting part and an edge of the opening.

19. The condenser microphone chip according to claim 17, further comprising:

a reinforcing rib connected with the backplate for reinforcing a stiffness of a region of the backplate except the predetermined region of the suspended region.

20. The condenser microphone chip according to claim 8, wherein the curved beam extends in one of a substantial "S" shape, a shape of a substantial arc, and a substantial helical shape.

21. A condenser microphone chip, comprising:

a substrate having a through hole;

a backplate connected with the substrate and having a suspended region opposing the through hole of the substrate;

a diaphragm spaced from the backplate; and a supporting member supported between the diaphragm and the suspended region, wherein a predetermined region of the suspended region around the supporting member has a stiffness lower than that of the other region of the suspended region.

22. The condenser microphone chip according to claim 21, further comprising a curved beam connected with the diaphragm to anchor the diaphragm to the substrate.

23. The condenser microphone chip according to claim 21, further comprising:

an auxiliary beam including a first portion configured by forming an opening in the diaphragm at a predetermined distance from an edge of the diaphragm, the first portion having two ends connected with the diaphragm; and a second portion extending from the first portion away from the diaphragm, the second portion being fixed at an end of the second portion away from the first portion to the substrate.

24. The condenser microphone chip according to claim 23, further comprising:

an auxiliary beam support fixed to the substrate, the end of the second portion of the auxiliary beam being fixed to the substrate by connecting to the auxiliary beam support; and a diaphragm side electrode which is attached to the end of the second portion of the auxiliary beam connected to the auxiliary beam support so as to be electrically connected with the diaphragm.

25. The condenser microphone chip according to claim 21, further comprising:

a curved beam support which is fixed to the substrate and to which the curved beam is connected at an end of the curved beam; and a diaphragm side electrode which is attached to the end of the curved beam connected to the curved beam support so as to be electrically connected with the diaphragm.

26. The condenser microphone chip according to claim 21, further comprising:

a curved beam connecting part having a shape of a substantially circular plate, wherein the curved beam is arranged in the diaphragm, and wherein each curved beam includes a plurality of sub beams, each of the plurality of sub beams including a first sub beam portion extending in a substantially radial direction from a circumference of the curved beam connecting part; a second sub beam portion extending in a substantially circumferential direction from an end of the first sub beam portion away from the circumference of the curved beam connecting part and having a shape of a substantial arc; and a third sub beam portion extending in the radial direction from an end of the second sub beam portion away from the first sub beam portion and connected to the diaphragm.

27. The condenser microphone chip according to claim 21, further comprising:

a reinforcing rib connected with the backplate for reinforcing a stiffness of a region of the backplate except the predetermined region of the suspended region.

28. The condenser microphone chip according to claim 21, wherein the predetermined region of the suspended region comprises:

an opening formed at a center portion of the suspended region, a backplate beam connecting part located at a center portion of the opening, and a plurality of backplate beams connected between the backplate beam connecting part and an edge of the opening.

* * * * *